US009561511B2

(12) United States Patent
Nishijima et al.

(10) Patent No.: US 9,561,511 B2
(45) Date of Patent: Feb. 7, 2017

(54) METHOD AND APPARATUS FOR SEPARATION OF MIXTURE

(75) Inventors: Shigehiro Nishijima, Osaka (JP); Fumihito Mishima, Osaka (JP); Koji Kaiso, Yamaguchi (JP); Toshihiro Shimakawa, Yamaguchi (JP)

(73) Assignees: UBE INDUSTRIES, LTD., Yamaguchi (JP); OSAKA UNIVERSITY, Osaka (JP)

( * ) Notice: Subject to any disclaimer, the term of this patent is extended or adjusted under 35 U.S.C. 154(b) by 387 days.

(21) Appl. No.: 14/239,657

(22) PCT Filed: Aug. 24, 2012

(86) PCT No.: PCT/JP2012/071391

§ 371 (c)(1),
(2), (4) Date: Feb. 19, 2014

(87) PCT Pub. No.: WO2013/027818

PCT Pub. Date: Feb. 28, 2013

(65) Prior Publication Data

US 2014/0202960 A1 Jul. 24, 2014

(30) Foreign Application Priority Data

Aug. 25, 2011 (JP) ..... 2011-183958
Oct. 26, 2011 (JP) ..... 2011-235397

(51) Int. Cl.
*B03C 1/32* (2006.01)
*B03C 1/032* (2006.01)
(Continued)

(52) U.S. Cl.
CPC ..... *B03C 1/32* (2013.01); *B03C 1/032* (2013.01); *B03C 1/286* (2013.01); *B03C 1/30* (2013.01); *B03C 2201/18* (2013.01)

(58) Field of Classification Search
CPC ..... B03C 1/32; B03C 1/015; B03C 1/002; B03C 1/28; B03C 1/286; B03C 1/288; B03C 1/0335; B03C 1/032; B03C 1/30; B03C 1/02; B03C 2201/18; B03C 2201/20; B03C 2201/22; B03B 5/28; B03B 5/30; B03B 5/36; B03B 5/44
See application file for complete search history.

(56) References Cited

U.S. PATENT DOCUMENTS 3,483,968 A 12/1969 Kaiser
3,483,969 A 12/1969 Rosensweig
(Continued)

FOREIGN PATENT DOCUMENTS

EP 1 181 982 A1 2/2002
GB 2308319 A * 6/1997 ..... B03C 1/034
(Continued)

OTHER PUBLICATIONS

The International Bureau of WIPO, "English translation of International Preliminary Report on Patentability", Feb. 27, 2014, 5 pp.
(Continued)

*Primary Examiner* — David C Mellon
(74) *Attorney, Agent, or Firm* — Eckert Seamans; John Powers; Grant Coffield

(57) ABSTRACT

The present invention is a method for applying a gradient magnetic field to a paramagnetic supporting liquid containing a mixture of first particles and second particles to separate the mixture by particle type. A magnetic susceptibility of the first particles is lower than that of the liquid, and a magnetic susceptibility of the second particles is higher than that of the liquid. A gradient magnetic field is applied to the liquid in a separation tank provided with a magnetic filter and the liquid is stirred. The first particles float in the liquid by a magneto-Archimedes effect. A horizontal magnetic force acts on the first particles by the gradient magnetic
(Continued)

field, so that the first particles travel to a region lateral to or outward from the magnetic filter and are gathered in the region. The magnetic filter is excited by the gradient magnetic field to catch the second particles.

12 Claims, 14 Drawing Sheets

(51) Int. Cl.
*B03C 1/28* (2006.01)
*B03C 1/30* (2006.01)

(56) References Cited

U.S. PATENT DOCUMENTS

| | | | | |
|---|---|---|---|---|
| 3,788,465 | A * | 1/1974 | Reimers | B03B 5/30 209/1 |
| 4,062,765 | A | 12/1977 | Fay et al. | |
| 4,560,484 | A | 12/1985 | Friedlaender et al. | |
| 4,663,029 | A | 5/1987 | Kelland et al. | |
| 2002/0153295 | A1 * | 10/2002 | Kimura | B03C 1/32 210/222 |

FOREIGN PATENT DOCUMENTS

| | | | |
|---|---|---|---|
| JP | SHO 53-111575 | A | 9/1978 |
| JP | 2002-59026 | A | 2/2002 |
| JP | 2002-126495 | A | 5/2002 |
| JP | 2004-533915 | A | 11/2004 |
| WO | 2010/084945 | A1 | 7/2010 |

OTHER PUBLICATIONS

Mori, T., "The application of magneto-Archimedes effect to the practical glass separation", Extended Abstracts (The 49th Spring Meeting, 2002); The Japan Society of Applied Physics and Related Societies (1), Mar. 27, 2002, p. 491.

Mishima, F., et al., "High Gradient Superconducting Magnetic Separation for Iron Removal From the Glass Polishing Waste", IEEE Transactions on Applied Superconductivity, vol. 21 (3), Jun. 2011, pp. 2059-2062.

Japanese Patent Office, "International Search Report", Nov. 27, 2012, 4 pp.

European Patent Office, "extended European search report for EP 12 826 168.2", Mar. 4, 2015, 9 pp.

* cited by examiner

METHOD AND APPARATUS FOR SEPARATION OF MIXTURE

FIELD OF THE INVENTION

The present invention relates to a mixture separation method and a mixture separation apparatus for separating, by type, a mixture containing two types of particles, or for separating a specific type of particle from such a mixture.

BACKGROUND OF THE INVENTION

JP 2002-59026A (Patent Document 1) discloses a mixture separation method using a magneto-Archimedes effect. The mixture separation method disclosed in Patent Document 1 is characterized in that a magnetic field having a magnetic field gradient (referred to as "gradient magnetic field" hereinafter) is applied to a plastic mixture including a plurality of types of diamagnetic solid plastic particles that floats or sinks in a paramagnetic supporting liquid to float the plastic particles at positions corresponding to the types of particle.

On the other hand, a high gradient magnetic separation (HGMS) method as disclosed in JP 2004-533915A (Patent Document 2) is known as a method for adsorbing and separating particles of paramagnetic materials (feeble magnetic materials) in liquid or gas. In the HGMS method, a high gradient magnetic field is generated by applying a high magnetic field to a magnetic filter formed of fine wires of a ferromagnetic material to adsorb paramagnetic particles in liquid or gas on the magnetic filter.

PRIOR ART REFERENCES

Patent Documents

Patent Document 1: JP 2002-59026A
Patent Document 2: JP 2004-533915A

DISCLOSURE OF THE INVENTION

Problems to be Solved by the Invention

The magneto-Archimedes effect can be used to float paramagnetic particles at a position or height corresponding to their magnetic susceptibility and density in the supporting liquid. Accordingly, a gradient magnetic field is applied to paramagnetic particles and diamagnetic particles in the supporting liquid, and the magneto-Archimedes effect can be used to float these particles at different heights and separate them.

When the magneto-Archimedes effect is used to float paramagnetic particles in the paramagnetic supporting liquid, the difference between the magnetic susceptibility of the supporting liquid and the magnetic susceptibility of the paramagnetic particles is small compared to the case of floating diamagnetic particles, and therefore, it is required to apply a gradient magnetic field having a very large magnetic field and/or magnetic field gradient thereto. However, when generating the gradient magnetic field required to float the paramagnetic particles, the load on the apparatus that generates the magnetic field is increased.

When the concentration of a paramagnetic material (e.g., paramagnetic inorganic salt) that is dissolved in the supporting liquid is increased to increase the magnetic susceptibility of the supporting liquid, the magnitude of a magnetic field and/or magnetic field gradient required to float the paramagnetic particles can be reduced. However, increasing in the paramagnetic material concentration is not preferable because the viscosity of the supporting liquid is increased and it takes a long time to separate the mixture. Particularly, if the particle size of the mixture is small, the influence of the viscosity of the supporting liquid markedly appears in the separation process. Furthermore, a supporting liquid in which a paramagnetic material has been dissolved in a high concentration is not preferable because it becomes difficult to recycle or dispose of the supporting liquid. For these reasons, a separation method using the magneto-Archimedes effect is not used to separate a mixture containing paramagnetic particles.

On the other hand, even if a mixture containing paramagnetic particles and diamagnetic particles is treated using the HGMS method, the paramagnetic particles are caught with the magnetic filter, but the diamagnetic particles remain suspended in the medium. Accordingly, if the diamagnetic particles need to be collected from the medium, a process of separating and collecting the diamagnetic particles needs to be separately performed before or after the separation process by the HGMS method, and therefore, an apparatus for separating and collecting diamagnetic particles is separately required in addition to the apparatus for the HGMS method.

The present invention solves the above-described problems and provides a mixture separation method and a mixture separation apparatus for separating, by type, a mixture containing two types of particles, or for separating a specific type of particle from such a mixture, the mixture separation method and the mixture separation apparatus reducing the load on the apparatus configuration and being capable of preforming processes efficiently in a short time compared to conventional methods.

Means for Solving the Problems

The mixture separation method of the present invention is a mixture separation method for one of separating, by particle type, a mixture of first particles and second particles of different types by applying a gradient magnetic field to a paramagnetic supporting liquid containing the mixture, and separating, by applying a gradient magnetic field to a paramagnetic supporting liquid containing a mixture of first particles and second particles of different types, the first particles or the second particles from the mixture, wherein a magnetic susceptibility of the first particles is lower than a magnetic susceptibility of the supporting liquid, and a magnetic susceptibility of the second particles is higher than the magnetic susceptibility of the supporting liquid, and the mixture separation method comprises applying the gradient magnetic field to the supporting liquid in a separation tank provided with a magnetic filter means and stirring the supporting liquid, floating the first particles in the supporting liquid by a magneto-Archimedes effect and catching the second particles in the supporting liquid with the magnetic filter means excited by the gradient magnetic field.

The mixture separation apparatus of the present invention is a mixture separation apparatus for one of separating, by particle type, a mixture of first particles and second particles of different types by applying a gradient magnetic field to a paramagnetic supporting liquid containing the mixture, and separating, by applying a gradient magnetic field to a paramagnetic supporting liquid containing a mixture of first particles and second particles of different types, the first particles or the second particles from the mixture, wherein a magnetic susceptibility of the first particles is lower than a magnetic susceptibility of the supporting liquid, and a magnetic susceptibility of the second particles is higher than the magnetic susceptibility of the supporting liquid, and the mixture separation apparatus comprises a separation tank in which the supporting liquid is stored or to which the supporting liquid is sent, a magnetic field generating means for generating the gradient magnetic field, a magnetic filter means provided in the separation tank and a stirring means for stirring the supporting liquid in the separation tank, wherein the gradient magnetic field is applied to the supporting liquid in the separation tank and the supporting liquid is stirred, the first particles float in the supporting liquid by a magneto-Archimedes effect, and the second particles in the supporting liquid are caught with the magnetic filter means excited by the gradient magnetic field.

In the mixture separation method and separation apparatus of the present invention, the gradient magnetic field may be applied so that the first particles float in the supporting liquid or at the liquid surface thereof by the magneto-Archimedes effect, at least over the magnetic filter means.

In the mixture separation method and separation apparatus of the present invention, a horizontal magnetic force may act on the first particles by the gradient magnetic field, and the first particles may travel to a region lateral to or outward from the magnetic filter means by the magnetic force and be gathered in the region.

In the mixture separation method and separation apparatus of the present invention, the first particles may be gathered so as to be positioned at the substantially same height in the supporting liquid.

In the mixture separation method and separation apparatus of the present invention, the gradient magnetic field may be axially symmetrical about a central axis in a vertical direction, a magnetic field gradient of the gradient magnetic field may have a component of a vertical direction and a component of a radial direction, and a magnetic force in a radial direction may be applied to the first particles so that the first particles move away from the central axis by applying the gradient magnetic field to the supporting liquid.

In the mixture separation method and separation apparatus of the present invention, the first particles may be formed of a diamagnetic material or a paramagnetic material, the second particles may be formed of a paramagnetic material or an antiferromagnetic material, and the supporting liquid may be an aqueous solution of a paramagnetic inorganic salt.

In the mixture separation method and separation apparatus of the present invention, the magnetic filter means may include a net plate formed of a ferromagnetic material, and the gradient magnetic field may be applied substantially orthogonally to the net plate.

Advantageous Effects of the Invention

In the present invention, gathering the first particles using the magneto-Archimedes effect and catching the second particles with the magnetic filter means are performed in a separation tank at the same time, and therefore, the mixture is efficiently separated in a short time. Furthermore, in the present invention, since the magnetic filter means is excited by the gradient magnetic field generated to cause the magneto-Archimedes effect, the apparatus configuration is simplified compared to the case of performing the separation treatment using a conventional method. Gathering the first particles using the magneto-Archimedes effect and catching the second particles with the magnetic filter means are promoted or assisted by stirring the supporting liquid.

In the present invention, if the first particles are gathered in a region lateral to or outward from the magnetic filter means for catching the second particles, the first particles and the second particles can be separated by type without largely increasing the distance in the vertical direction between the first particles and the second particles. Accordingly, the magnetic susceptibility of the supporting liquid can be reduced compared to a conventional separation method and separation apparatus using the magneto-Archimedes effect. As a result, the viscosity of the supporting liquid, that is, the resistance by the particles in the supporting liquid can be reduced to quickly or efficiently perform the separation treatment. Furthermore, in this case, the first particles are gathered in a region spaced from the magnetic filter means for catching the second particles, and therefore, compared to a conventional separation method and separation apparatus using the magneto-Archimedes effect, the distance between the regions for gathering particles can be increased to enhance the capability of separation and the accuracy of separation.

DETAILED DESCRIPTION OF THE INVENTION

Figure 1:
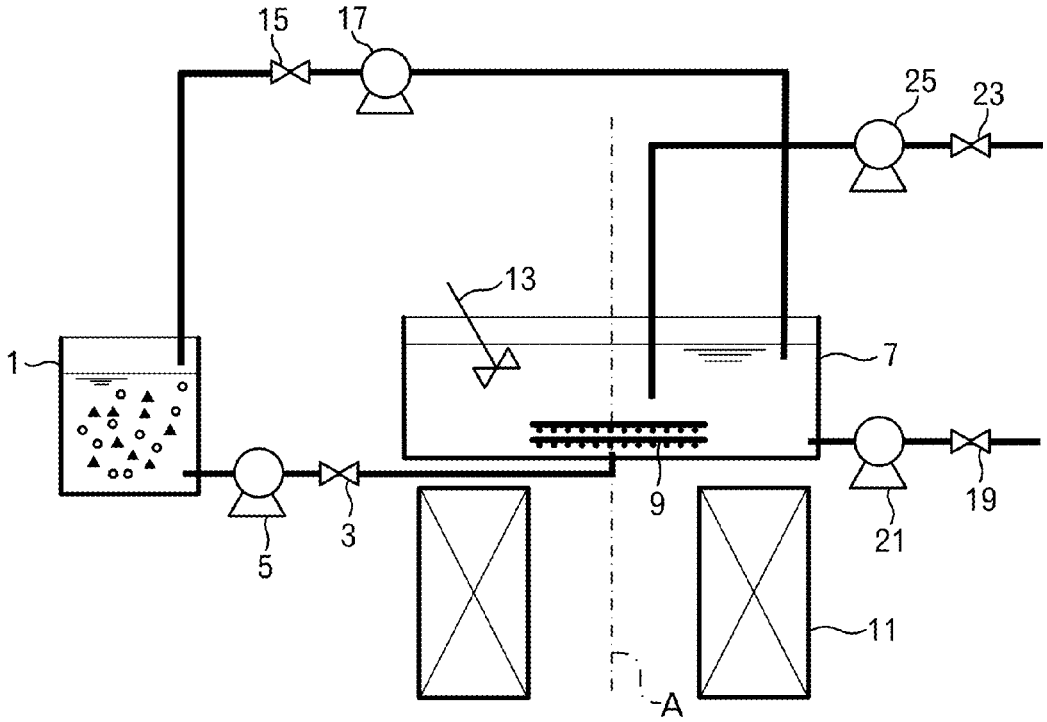
FIG. 1 is an explanatory drawing showing the outline of a mixture separation apparatus according to a first embodiment of the present invention.

A mixture to be treated by the mixture separation method and the mixture separation apparatus of the present invention contains first particles and second particles that are different in type (more specifically, formed of different materials), and is subjected to a separation treatment in a state where the mixture is suspended in the supporting liquid. The magnetic susceptibility (more specifically, volume magnetic susceptibility; the same applies hereinafter) of the first particles is lower than that of the supporting liquid used for the present invention, and the magnetic susceptibility of the second particles is higher than that of the supporting liquid.

In the present invention, the supporting liquid is paramagnetic, and, for example, an aqueous solution of paramagnetic inorganic salt is used as the supporting liquid of the present invention. Examples of the paramagnetic inorganic salt used for the supporting liquid of the present invention include manganese chloride, cobalt chloride, nickel chloride, ferrous chloride, cobalt nitrate, nickel nitrate, gadolinium nitrate, dysprosium nitrate, and terbium nitrate. There is no limitation or restriction on the concentration of the paramagnetic salt in the supporting liquid as long as the effect of the present invention can be obtained.

The first particles of the mixture to be treated by the present invention may be formed of a diamagnetic material. For example, the first particles may be formed of glass (silica) or plastics (e.g., nylon and polyethylene terephthalate). Also, the first particles may be formed of a paramagnetic material such as aluminum.

The second particles of the mixture to be treated in the present invention may be formed of a paramagnetic material or antiferromagnetic material. For example, the second particles may be formed of titanium (paramagnetic material) or nickel oxide (antiferromagnetic material). Also, the second particles may be formed of a ferromagnetic material such as iron, nickel or maghemite.

In the present invention, it should be noted that as long as the magnetic susceptibility of the first particles is lower than that of the supporting liquid and the magnetic susceptibility of the second particles is higher than that of the supporting liquid (and additionally, if both of the densities of the first particles and the second particles are greater or smaller than that of the supporting liquid), there is no limitation on the materials of which the first particles and the second particles are formed. Although the first particles are formed of a diamagnetic material and the second particles are formed of a paramagnetic material or an antiferromagnetic material in the first to fifth examples described later, the present invention is also applicable to a case where, for example, the first particles are formed of a paramagnetic material (e.g., titanium) and the second particles are formed of a ferromagnetic material (e.g., maghemite). If the magnetic susceptibility of the first particles is lower than that of the supporting liquid and the magnetic susceptibility of the second particles is higher than that of the supporting liquid, both of the first particles and the second particles may be paramagnetic.

Although there is no limitation on the particle size or the average particle size of the first particles and the second particles in the present invention, the particle size or the average particle size of these particles is likely to be set to approximately several micrometers to several centimeters. Moreover, there is no limitation on the shapes of the particles in the present invention. The mixture may be produced by crushing or pulverizing a mass containing a plurality of materials, and the shapes of the particles contained in the mixture need not be uniform or identical.

When a gradient magnetic field is applied to the supporting liquid in which the mixture containing the first particles and the second particles is suspended, the apparent weight per unit volume of these particles is given by the following expression;

$$(\rho_i-\rho)g\pm(\chi_i-\chi)/\mu_0 \cdot B\partial B/\partial z$$

where $\rho_i$ is the density of the first particles or the second particles (i=1 or 2), $\chi_i$ is the magnetic susceptibility (volume magnetic susceptibility) of the first particles or the second particles (i=1 or 2), $\rho$ is the density of the supporting liquid, $\chi$ is the magnetic susceptibility (volume magnetic susceptibility) of the supporting liquid, g is the acceleration of gravity, $\mu_0$ is the permeability in vacuum, B is the magnetic field (magnetic flux density), $\partial B/\partial z$ is the magnetic field gradient, and z is a coordinate in a vertical direction (downward direction is taken as positive).

If $(\rho_i-\rho)>0$ (i.e., in the case where the first particles settle in the supporting liquid when a gradient magnetic field is not applied), the magnetic susceptibility of the supporting liquid is given such that $(\chi_i-\chi)<0$ and the product of the magnetic field and the magnetic field gradient is a large positive number, so that the apparent weight represented by the above expression is negative and the first particles levitate or float in the supporting liquid. For example, when a magnet is provided under a tank storing the supporting liquid and a gradient magnetic field in which the magnetic field increases in the vertically downward orientation is applied to the supporting liquid, the first particles levitate in the supporting liquid. At the balanced height or position where the apparent weight represented by the above expression is zero, the first particles stably float by the magneto-Archimedes effect (i.e., by a magnetic force in a vertical direction resulting from a gradient magnetic field (the second term in the above expression) acting on the first particles in the supporting liquid). The balanced height depends on the density and magnetic susceptibility of the first particles. If the liquid surface of the supporting liquid is lower than the balanced height where the apparent weight represented by the above expression is zero, the first particles are disposed at the liquid surface of the supporting liquid.

If $(\rho_i-\rho)<0$ (i.e., in the case where the first particles float at the liquid surface of the supporting liquid when a gradient magnetic field is not applied), the magnetic susceptibility of the supporting liquid is given such that $(\chi_i-\chi)<0$ and the product of the magnetic field and the magnetic field gradient is a large negative number, so that the apparent weight represented by the above expression is positive and the first particles settle in the supporting liquid. For example, when a magnet is provided over a tank storing the supporting liquid and a gradient magnetic field in which the magnetic field increases in the vertically upward orientation is applied to the supporting liquid, the first particles settle in the supporting liquid. At the balanced height or position where the apparent weight represented by the above expression is zero, the first particles stably float by the magneto-Archimedes effect. If the bottom face of the separation tank storing the supporting liquid is higher than the balanced height where the apparent weight represented by the above expression is zero, the first particles are disposed on the bottom face of the separation tank.

Since the magnetic susceptibility of the second particles is higher than that of the supporting liquid, $(\chi_2-\chi)>0$ in the above expression representing the apparent weight. As a result, a gradient magnetic field is applied as described above in the case where $(\rho_2-\rho)>0$ (i.e., a gradient magnetic field is applied such that the first particles levitate in the case where $(\rho_1-\rho)>0$), so that the apparent weight of the particles is not zero (and remains positive) and the second particles settle in the supporting liquid. Moreover, a gradient magnetic field is applied as described above in the case where $(\rho_2-\rho)<0$ (i.e., a gradient magnetic field is applied such that the first particles settle in the case where $(\rho_1-\rho)<0$), so that the apparent weight of the particles is not zero (and remains negative) and the second particles float at the liquid surface of the supporting liquid. Thus, the first particles and the second particles in the supporting liquid are vertically separated.

The present invention uses a magnetic filter means to catch the second particles in the supporting liquid. A magnetic filter means is conventionally used to adsorb paramagnetic materials and ferromagnetic materials in the HGMS method. One or more net plates formed of fine wires of a ferromagnetic material, an expanded metal or a punching metal, or a large number of prisms and spheres formed of a ferromagnetic material can be used as a magnetic filter means of the present invention, and a shape suitable for an apparatus for carrying out the present invention may be selected. If a gradient magnetic field acts on the second particles so as to settle them, a magnetic filter means is provided on the bottom face of the separation tank or in the vicinity thereof. If a gradient magnetic field acts on the second particles so as to float them at the liquid surface of the supporting liquid, a magnetic filter means is provided at the liquid surface of the supporting liquid or in the vicinity thereof.

In the present invention, by applying a gradient magnetic field to the supporting liquid in the separation tank, the first particles are floated in the supporting liquid (or at the liquid surface of the supporting liquid) by the magneto-Archimedes effect, or the first particles are sunk on the bottom face of the separation tank by the magneto-Archimedes effect as described above, so that the first particles are arranged at a substantially constant height in a vertical direction. Furthermore, as described below, the first particles may be gathered in the regions spaced laterally or outward from the magnetic filter means in the separation tank by supplying a magnetic force in a lateral direction or a horizontal direction resulting from a gradient magnetic field. The second particles are caught with a magnetic filter means as described above.

In the present invention, the magnetic field gradient of the gradient magnetic field may have a component of a horizontal direction ($\partial B/\partial x$ and/or $\partial B/\partial y$) in addition to a component of a vertical direction ($\partial B/\partial z$) (x and y are coordinates in horizontal directions that are orthogonal to each other). Moreover, in the present invention, a gradient magnetic field may have a component of a horizontal direction. When the magnetic field gradient of the gradient magnetic field has a component of a horizontal direction in addition to a component of a vertical direction, or a gradient magnetic field has a component of a horizontal direction, a magnetic force in a horizontal direction expressed in a similar manner to the second term of the above expression representing the apparent weight acts on the first particles, so that the first particles travel in a horizontal direction. A floating height of the first particles may vary as the first particles travel horizontally. For example, if the magnetic field gradient of the gradient magnetic field has a horizontal component ($\partial B/\partial x$) in addition to a vertical component ($\partial B/\partial z$), the first particles float or sink by the magneto-Archimedes effect, travel along the x axis, and are finally gathered on the wall surface of the separation tank at a substantially constant height in a vertical direction, that is, at the balanced height where the apparent weight is zero, at the liquid surface of the supporting liquid, or on the bottom face of the separation tank (the first particles may be gathered on or below a shelf or the like provided in the separation tank). For example, a magnetic filter means is arranged on the opposite side to the wall surface in the separation tank, so that the first particles travel in a lateral direction so as to move away from the magnetic filter means. A magnetic force in an opposite direction to a force applied to the first particles (at the same position as the second particles) is applied to the second particles by applying a gradient magnetic field to the second particles, and therefore, the second particles travel in the opposite direction of the first particles, approach the magnetic filter means and are caught. Thus, the first particles and the second particles are horizontally separated.

For example, if a gradient magnetic field is axially symmetrical about its central axis in a vertical direction and a magnetic field gradient or a gradient magnetic field has a component of a radial direction in addition to a component of a vertical direction, the first particles float or sink in the supporting liquid by the magneto-Archimedes effect, travel in a radial direction (i.e., radially from the central axis) with a magnetic force in a radial direction, and are finally disposed on the wall surface of the separation tank. The first particles are arranged on the wall surface at the balanced height, at the liquid surface of the supporting liquid, or on the bottom face of the separation tank. In order to increase the distance between the region for gathering the first particles and a magnetic filter means for catching the second particles (and, additionally, to strongly excite a magnetic filter means with a gradient magnetic field) and enhance the accuracy of separation, it is desirable to arrange the magnetic filter means in the vicinity of the central axis of the gradient magnetic field, or so as to intersect with or cross orthogonally to the central axis.

In the present invention, a solenoid superconducting electromagnet, a superconducting bulk magnet, a non-superconducting electromagnet, or a permanent magnet may be used as a magnetic field generating means for generating a gradient magnetic field, and there is no limitation thereon as long as the effect of the present invention can be obtained. It is preferable that a magnetic filter means is arranged in proximity to a magnetic pole of the magnetic field generating means or in the region where the gradient magnetic field is large. The magnetic field generating means may include a plurality of magnets and a gradient magnetic field may be obtained by composition of magnetic fields generated by these magnets. For example, the magnetic field generating means may include a first magnet that applies a gradient magnetic field in a vertical direction for floating or sinking the first particles by the magneto-Archimedes effect and exciting the magnetic filter means, and a second magnet that applies a gradient magnetic field in a horizontal direction for causing the first particles to travel in a lateral direction. Furthermore, the second magnet may generate a gradient magnetic field intermittently or in a predetermined cycle.

If a difference between the magnetic susceptibility of the second particles $\chi_2$ and the magnetic susceptibility of the supporting liquid $\chi$ is small (e.g., the second particles are paramagnetic or antiferromagnetic), the influence of the term depending on a gradient magnetic field in the apparent weight represented by the above expression is small. A magnetic force in a horizontal or a radial direction for causing the second particles to travel in a lateral direction is also small. Furthermore, if the particle size of the second particle is small, the motion of the second particles in the supporting liquid is easily affected by hydrodynamic effects. Since a strong magnetic force acts on the second particles only in the vicinity of the magnetic filter means, some of the second particles with a small particle size may remain suspended in the supporting liquid without being caught with the magnetic filter means even if a gradient magnetic field is applied thereto. Furthermore, some of the second particles precipitated on the bottom face of the separation tank at a site spaced from the magnetic filter means may remain stationary at that site.

In the present invention, the second particles suspended or precipitated at a site spaced from the magnetic filter means may be introduced to the magnetic filter means by stirring the supporting liquid in a state of applying a gradient magnetic field thereto. This enables a period of time required for the separation treatment to be shortened or the region where the second particles are distributed in the supporting liquid to be narrowed. Examples of a method for stirring the supporting liquid include mechanical stirring, vibration stirring, jet stream stirring, stirring by blowing gas, and ultrasonic stirring, and a plurality of methods may be used together. It is preferable that a flow toward the magnetic filter means is generated in the supporting liquid by stirring. In the present invention, in addition to a gradient magnetic field, a flow of the supporting liquid in the separation tank may be used to separate and collect the first particles and the second particles. For example, when a gradient magnetic field that is axially symmetrical about its central axis in a vertical direction is used to gather the first particles on the inner wall of a cylindrical separation tank (see the first embodiment and the like described below), a flow may assist to gather the first particles by generating a circulating flow directed to the bottom face along the inner wall in the supporting liquid in the separation tank (to an extent that the gathered particles are not diffused). Moreover, the first particles may be collected from the separation tank by generating a flow of the supporting liquid that is orthogonal with respect to a magnetic force in a horizontal direction for acting on the gathered first particles or a flow in a circumferential direction in the supporting liquid that is orthogonal with respect to a magnetic force in a radial direction for acting on the gathered first particles (see the fifth embodiment described below).

There is no limitation on the depth of the supporting liquid in the separation tank (a distance from the bottom face of the separation tank to the liquid surface of the supporting liquid) as long as the effect of the present invention can be obtained. When the first particles are caused to travel to a region lateral to or outward from the magnetic filter means by a magnetic force in a horizontal direction due to a gradient magnetic field and gathered therein (e.g., see the first to fifth embodiment described below), it is possible to largely increase the distance between the region where the first particles are gathered and the region where the second particles are caught in a lateral, horizontal, or radial direction. Accordingly, in this case, the first particles and the second particles need not be separated in a vertical direction, and therefore, the depth of the supporting liquid in the separation tank may be relatively small (e.g., the first particles may travel in a horizontal direction while floating at the liquid surface of the supporting liquid). Furthermore, when the first particles are caused to travel to a region lateral to or outward from the magnetic filter means by a magnetic force in a horizontal direction due to a gradient magnetic field and gathered therein, the first particles need not be levitated at a high position or sunk in a low position, and therefore, the volume magnetic susceptibility of the supporting liquid need not be enlarged compared to a conventional method. Accordingly, with the present invention, the concentration of paramagnetic salt in the supporting liquid, and the viscosity of the supporting liquid as well can be reduced to shorten a period of time required for the separation treatment of the mixture.

The mixture separation method of the present invention may be performed by continuous processing or batch processing, and the mixture separation apparatus of the present invention may be a continuous type or a batch type. FIG. 1 is an explanatory drawing showing the outline of the mixture separation apparatus according to the first embodiment of the present invention. The separation apparatus includes a storage tank (1) for storing the supporting liquid containing the mixture and a bottomed cylindrical separation tank (7) that is connected to the storage tank (1) via a channel provided with a first valve (3) and a first pump (5). The separation tank (7) has a cylindrical shape and is formed of nonmagnetic materials (materials with a small magnetic susceptibility) such as glass, plastic, and nonmagnetic metal (aluminum or nonmagnetic stainless steel). The first pump (5) is used to let the supporting liquid flow from the storage tank (1) to the separation tank (7), and the first valve (3) is opened and closed as appropriate depending on the process to be performed by the separation apparatus. The mixture to be subjected to the separation treatment is placed into the supporting liquid in the storage tank (1) as appropriate.

Moreover, the storage tank (1) is appropriately replenished with supporting liquid as needed.

In FIG. 1, the first particles contained in the mixture are indicated by black triangles, and the second particles are indicated by white circles (the first particles and the second particles in the separation tank (7) are not shown in FIG. 1). An aqueous solution of paramagnetic inorganic salt (e.g., 5 wt % aqueous solution of manganese chloride) is used as the supporting liquid. For example, the first particles are formed of a diamagnetic material such as glass (silica), and the second particles are formed of a paramagnetic material such as titanium or an antiferromagnetic material such as nickel oxide.

In the present embodiment, the supporting liquid in which the first particles and the second particles are suspended is released from an outlet provided in the vicinity of the center of the separation tank (7) bottom face into the separation tank (7). A magnetic filter means (9) is horizontally arranged over the outlet of the supporting liquid. In the present embodiment, two rectangular net plates formed of fine wires of a ferromagnetic material are used as the magnetic filter means (9). These net plates are arranged, for example, on the bottom face of the separation tank (7) in a vertically overlapped state. The number of net plates may be changed as appropriate.

A magnetic field generating means (11) for generating a gradient magnetic field is provided under the separation tank (7). In the present embodiment, a solenoid superconducting magnet is used as the magnetic field generating means (11), and the coil central axis A (indicated by a dashed line in FIG. 1) is vertically arranged. The gradient magnetic field generated by the magnetic field generating means (11) is axially symmetrical about the coil central axis A, and the magnetic field gradient thereof has a component of a vertical direction and a component of a radial direction (other than on the coil central axis A). For example, the magnetic field generating means (11) generates a magnetic field so that the magnetic field is directed vertically downward along the coil central axis A, and the magnetic field has a component of a radial direction at a position spaced from the coil central axis A. In the present embodiment, the diameter of the circular bottom face of the separation tank (7) is made sufficiently larger than the bore diameter of the magnetic field generating means (11), and the magnetic field to be applied to the supporting liquid in the separation tank (7) changes in the radial direction. The two rectangular net plates included in the magnetic filter means (9) are arranged so as to be substantially orthogonal with respect to the coil central axis A of the magnetic field generating means (11) at their centers so that the net plates are excited by a large gradient magnetic field. Moreover, in the present embodiment, the cylindrical separation tank (7) and the coil of the magnetic field generating means (11) are coaxially arranged.

In the present embodiment, a stirring means (13) for stirring the supporting liquid is provided in the separation tank (7). A stirring blade that is immersed in the supporting liquid stored in the separation tank (7) is used as the stirring means (13). The stirring blade is rotated by a driving means (not shown) and generates a flow directed toward the magnetic filter means (9) in the supporting liquid in the separation tank (7). For example, an ultrasonic generating apparatus may be used as the stirring means (13) to stir the supporting liquid using ultrasonic waves.

One end of the channel for collecting the supporting liquid is immersed in the supporting liquid in the separation tank (7), and the channel has a second valve (15) that is opened and closed as appropriate depending on the process to be performed by the separation apparatus and a second pump (17) for letting the supporting liquid flow, connecting the separation tank (7) and the storage tank (1). The channel is used to return the supporting liquid from which the first particles and the second particles are (to some extent or substantially) removed to the storage tank (1). While the supporting liquid circulates between the storage tank (1) and the separation tank (7), the inflow of the supporting liquid into the separation tank (7) and the outflow therefrom are adjusted so that the amount of the supporting liquid in the separation tank (7) is substantially constant.

Figure 2:
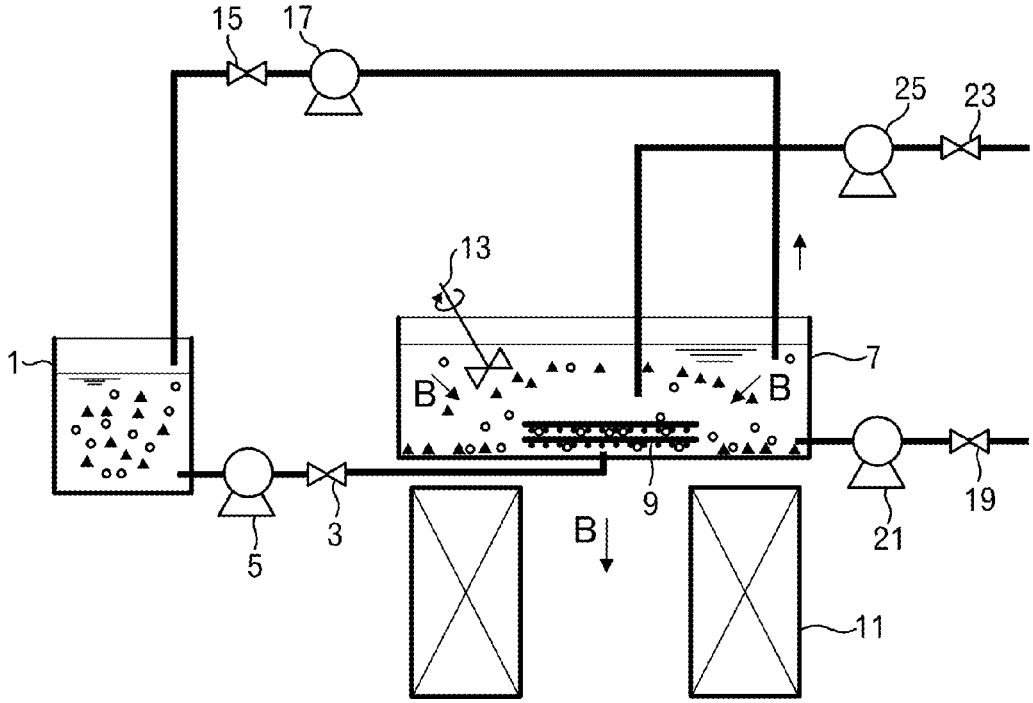
FIG. 2 is an explanatory drawing showing the operation of a mixture separation apparatus according to the first embodiment of the present invention.

As shown in FIG. 2, the first particles that are contained in the supporting liquid sent from the storage tank (1) to the separation tank (7) are floated through and above the magnetic filter means (9) by the magneto-Archimedes effect, and additionally, travel in the radial direction. The locus of the first particles sent to the separation tank (7) has a radial shape with the coil central axis A as a center. The gradient magnetic field is reduced as the distance from the coil central axis A increases, and, therefore, the height of the first particles decreases. When the balanced height where the apparent weight of the first particles is zero becomes lower than the bottom face of the separation tank (7), the first particles reach the bottom face of the separation tank (7), travel in the radial direction thereon, and reach the wall surface of the separation tank (7) or the edge of the bottom face. The first particles may travel in the radial direction while floating at the liquid surface in the separation tank (7) and reach the inner wall of the separation tank (7). Also, the first particles may float at the liquid surface in the separation tank (7) in the vicinity of the center of the separation tank (7) and, as the first particles travel in the radial direction, the height thereof may be reduced. Moreover, the first particles may reach the inner wall of the separation tank (7) and stably float at the balanced height. Furthermore, a shelf (e.g., an annular band-like member inwardly extending from the inner wall of the separation tank (7)) may be provided on the inner wall of the separation tank (7) and configured so that the first particles travel on the shelf when the balanced height of the first particles directed toward the inner wall of the separation tank (7) reach the upper surface of the shelf.

An inlet of a channel for collecting the first particles is provided on the inner wall of the separation tank (7). The channel includes a third valve (19) that is opened and closed as appropriate depending on the process to be performed by the separation apparatus and a third pump (21) for sucking the first particles, and is used to suck the first particles and send them to a storage tank (not shown). While the first valve (3) and the second valve (15) are open and the supporting liquid circulates between the storage tank (1) and the separation tank (7), the third valve (19) is closed. When the supporting liquid circulates between the storage tank (1) and the separation tank (7), the first particles accumulated on the edge of the bottom face of the separation tank (7) increase over time.

The present embodiment is configured so that the supporting liquid sent from the storage tank (1) to the separation tank (7) flows toward the magnetic filter means (9). Many of the second particles that are contained in the supporting liquid sent from the storage tank (1) to the separation tank (7) are trapped by the magnetic filter means (9). At that time, the second particles that are not trapped by the magnetic filter means (9) are returned to the magnetic filter means (9) and trapped by stirring the supporting liquid with the stirring means (13) so that a flow directed toward the magnetic filter means (9) is generated, or are returned to the storage tank (1) together with the supporting liquid. The supporting liquid is stirred by the stirring means (13) to an extent that the second particles caught do not separate from the magnetic filter means (9) and the first particles gathered separate from the edge of the bottom face of the separation tank (7). When the supporting liquid circulates between the storage tank (1) and the separation tank (7), the second particles caught with the magnetic filter means (9) increase over time. Moreover, the stirring means (13) stirs the supporting liquid so as to generate a flow directed toward the magnetic filter means (9), so that the second particles that sink on the bottom face of the separation tank (7) are trapped by the magnetic filter means (9). In the present embodiment, the magnetic filter means (9) is arranged over the outlet of the supporting liquid, but there is no limitation on the flow direction of the supporting liquid that is released into the separation tank (7) with respect to the magnetic filter means (9) in the embodiments of the present invention. For example, a channel connected to the storage tank (1) via the first valve (3) and the first pump (5) may be configured so that the supporting liquid is released toward the magnetic filter means (9) from above the magnetic filter means (9).

Figure 3:
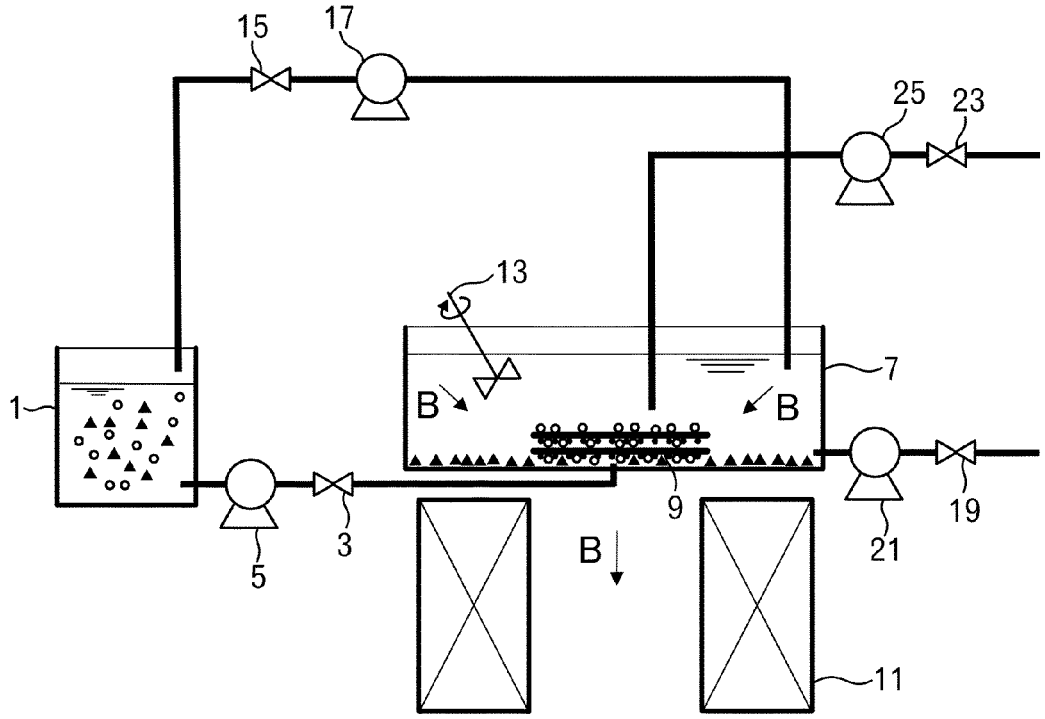
FIG. 3 is an explanatory drawing showing the operation of a mixture separation apparatus according to the first embodiment of the present invention.
Figure 4:
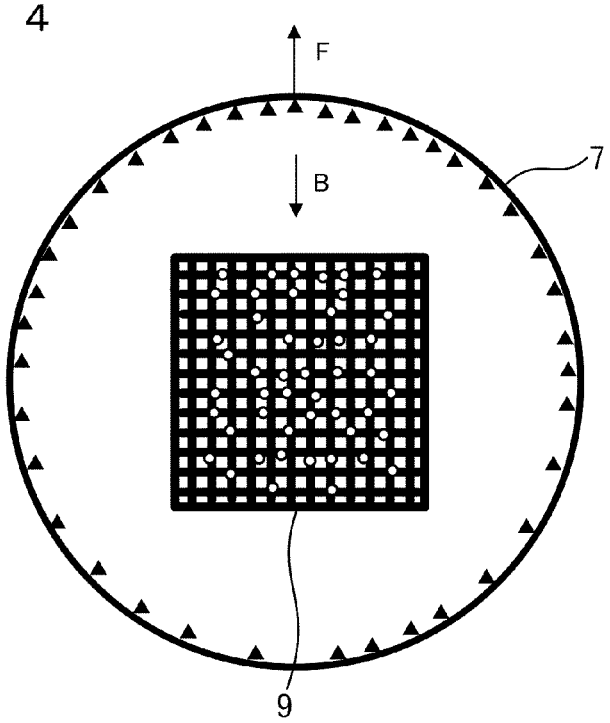
FIG. 4 is a top view of a separation tank of a mixture separation apparatus according to the first embodiment of the present invention.

When the above-described processing has been performed for a predetermined period of time, for example, the first valve (3) and the second valve (15) are closed and the circulation of the supporting liquid between the storage tank (1) and the separation tank (7) is stopped. Then, as shown in FIG. 3, the supporting liquid stored in the separation tank (7) is continuously stirred for a predetermined period of time, so that the second particles that are suspended in a region spaced from the magnetic filter means (9) are caught with or gathered on the magnetic filter means (9). When the supporting liquid is stirred for a predetermined period of time after the circulation of the supporting liquid has stopped, the stirring means (13) is stopped. FIG. 4 is a top view of the separation tank (7) and shows a state that the second particles (indicated by white circles) are trapped by the magnetic filter means (9) and the first particles (indicated by black triangles) on which the magnetic force F in the radial direction acts are gathered in an annular shape along the edge of the bottom face of the separation tank (7).

Figure 5:
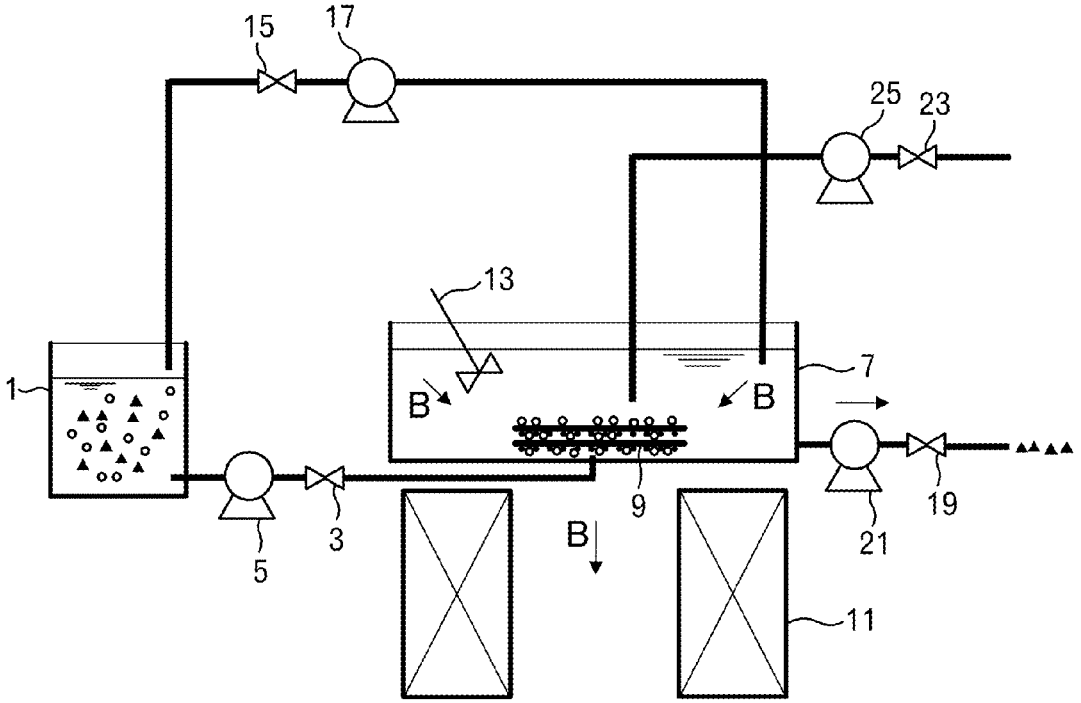
FIG. 5 is an explanatory drawing showing the operation of a mixture separation apparatus according to the first embodiment of the present invention.
Figure 6:
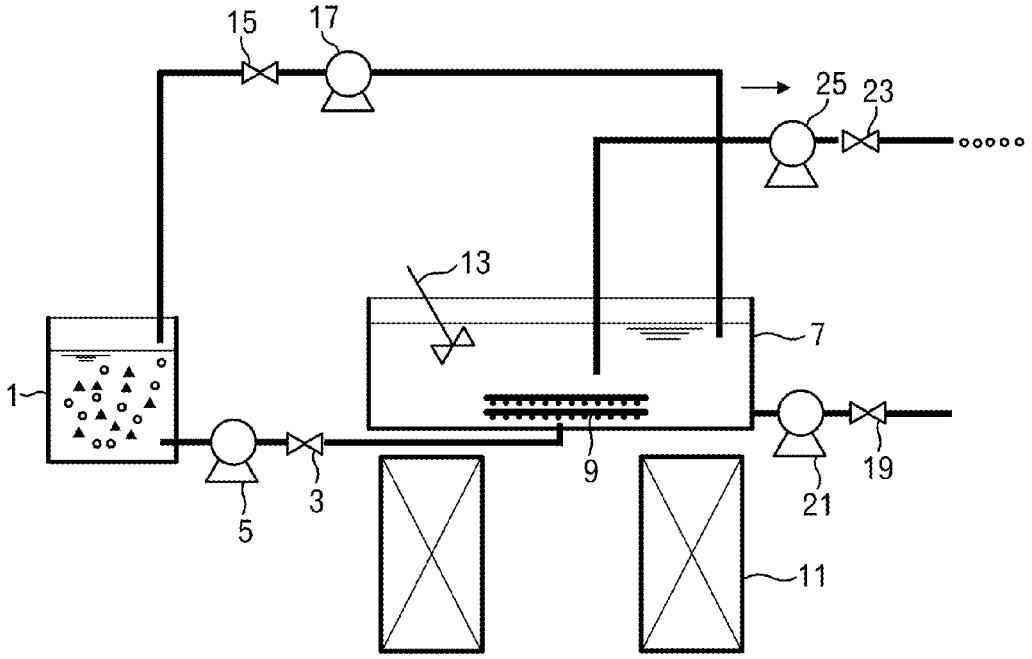
FIG. 6 is an explanatory drawing showing the operation of a mixture separation apparatus according to the first embodiment of the present invention.

After the stirring means (13) has stopped, as shown in FIG. 5, the third valve (19) is opened and a process of sucking and collecting the first particles is performed. As shown in FIG. 6, after the process of the first particles, a process of collecting the second particles is performed. In the separation tank (7), one end of a channel for collecting the second particles is immersed over the magnetic filter means (9) in the supporting liquid. The channel includes a fourth valve (23) that is opened and closed as appropriate depending on the process to be performed by the separation apparatus and a fourth pump (25) for letting the supporting liquid flow out of the separation tank (7). In the process of collecting the second particles, the third valve (19) is closed, the magnetic field generating means (11) is degaussed or demagnetized, and the closed fourth valve (23) is opened to suck the second particles separated from the magnetic filter means (9) together with the supporting liquid into a storage tank (not shown). It should be noted that the second particles may be separated from the magnetic filter means (9) by rotating the stirring blade of the stirring means (13) at high speed.

After the process of collecting the second particles is performed, the fourth valve (23) is closed and the second valve (15) in addition to the first valve (3) is opened, so that the above-described separation process is repeatedly performed. The separation apparatus of the present embodiment may be configured so that the process of collecting the second particles is performed when the process of collecting the first particles has been performed a predetermined number of times.

Figure 7:
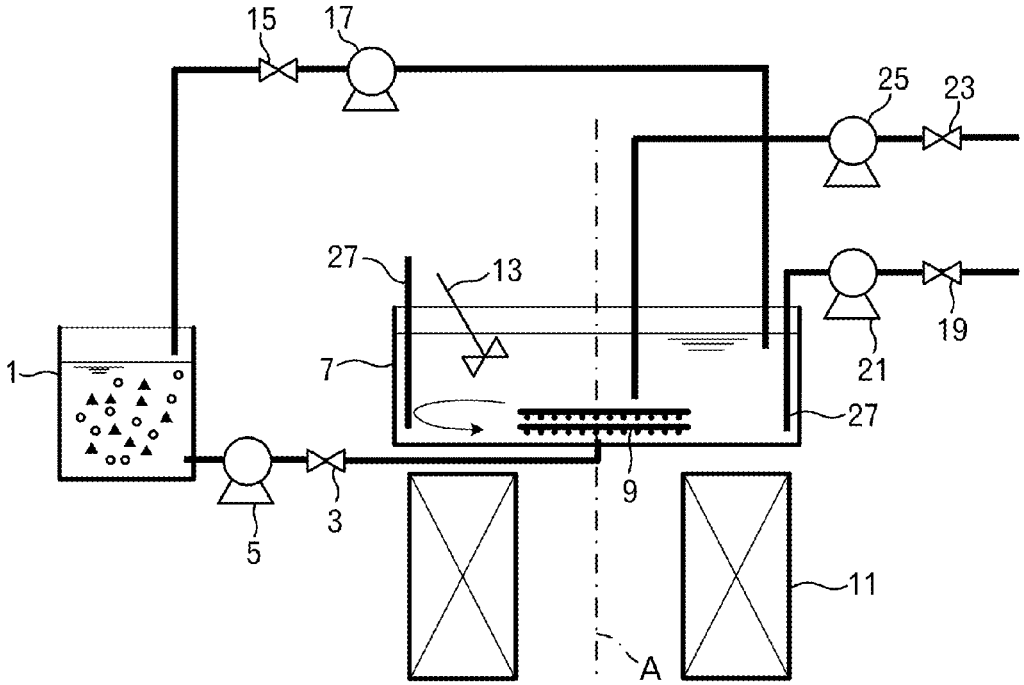
FIG. 7 is an explanatory drawing showing the outline of a mixture separation apparatus according to a second embodiment of the present invention.

FIG. 7 is an explanatory drawing showing the outline of a mixture separation apparatus according to a second embodiment of the present invention. The apparatus of the second embodiment differs from the above-described first embodiment in that a suction tube (27) for sucking the first particles is vertically arranged in proximity to the inner wall of the separation tank (7) so that one end thereof is located in the vicinity of the edge of the bottom face of the separation tank (7). The suction tube (27) is configured so that it can be moved by a driving mechanism (not shown) so as to trace a circle along the inner wall of the separation tank (7). The period of time required for collecting the first particles is shortened by collecting the first particles gathered on the edge of the separation tank (7) while moving the suction tube (27). It should be noted that the first particles may be collected by fixing the position of the suction tube (27) and rotating the separation tank (7) around the central axis. Since the separation apparatus of the second embodiment is configured in the same manner as the apparatus of the first embodiment except that the suction tube (27) is used to collect the first particles, further explanation related to the second embodiment is omitted.

Figure 8:
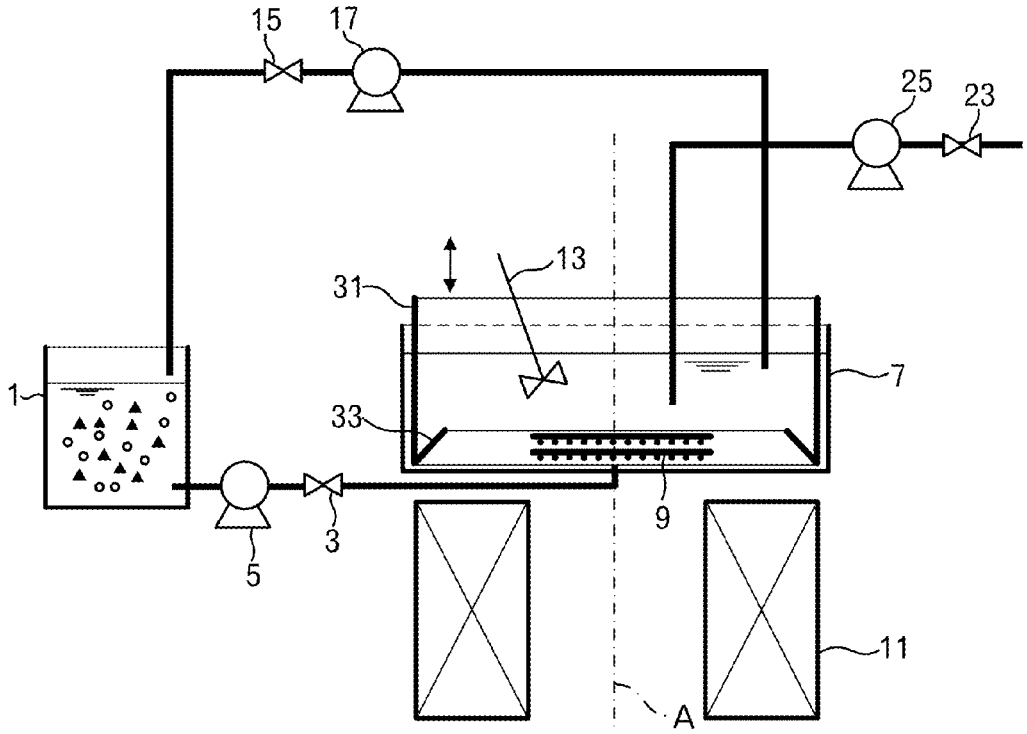
FIG. 8 is an explanatory drawing showing the outline of a mixture separation apparatus according to a third embodiment of the present invention.

FIG. 8 is an explanatory drawing showing the outline of a mixture separation apparatus according to a third embodiment of the present invention. The apparatus of the third embodiment uses a cylindrical collecting member (31) as a means for collecting the first particles. The bottom of the collecting member (31) is open. An upward tapered surface portion (33) that is formed in the truncated cone shape inwardly extends from the lower end of the collecting member (31), and a recess by the inner wall of the collecting member (31) and the tapered surface portion (33) is formed. The collecting member (31) is arranged so as to fit in the separation tank (7), and rises or falls by a lifting means (not shown).

Figure 9:
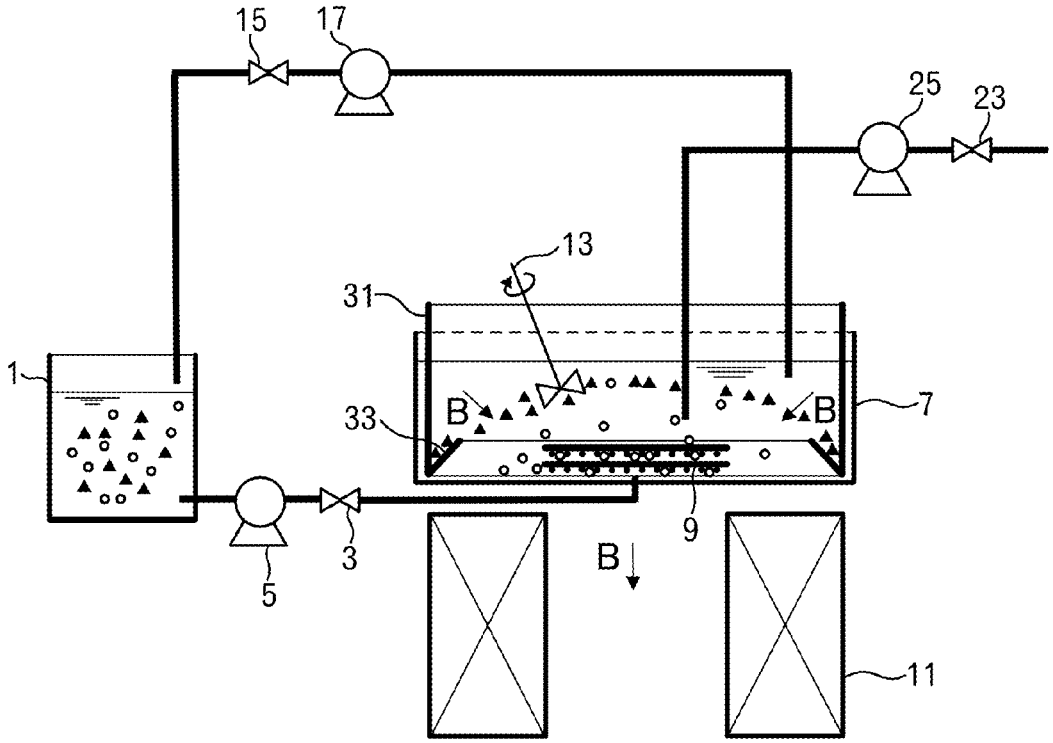
FIG. 9 is an explanatory drawing showing the operation of a mixture separation apparatus according to the third embodiment of the present invention.
Figure 10:
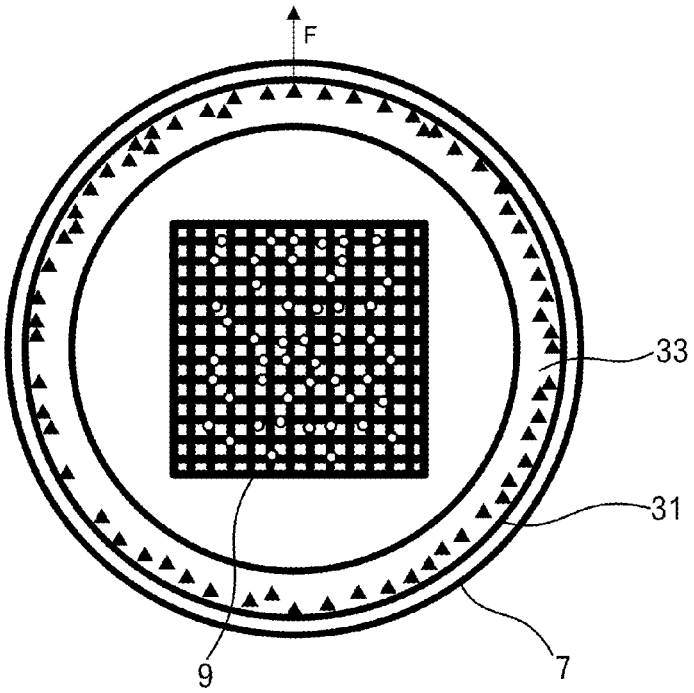
FIG. 10 is a top view of a separation tank of a mixture separation apparatus according to the third embodiment of the present invention.
Figure 11:
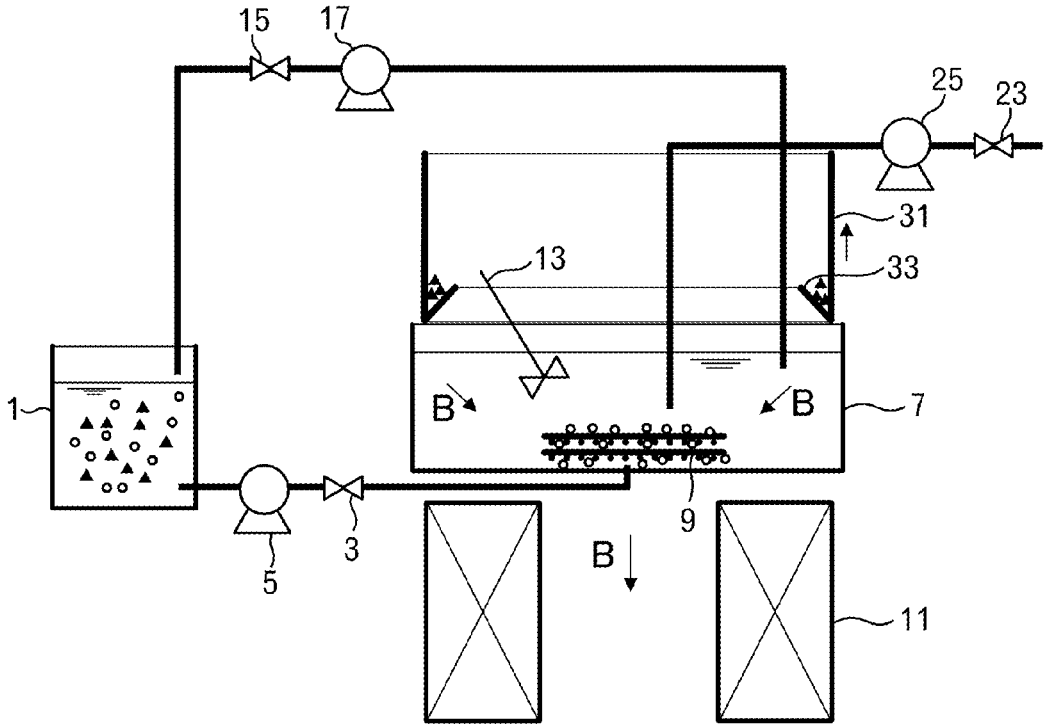
FIG. 11 is an explanatory drawing showing the operation of a mixture separation apparatus according to the third embodiment of the present invention.

In the separation process, the collecting member (31) is mounted on the bottom face of the separation tank (7), and as shown in FIG. 9, the first particles travel toward the recess formed by the inner wall of the collecting member (31) and the tapered surface portion (33) and are gathered. FIG. 10 is a top view of the separation tank (7) and the collecting member (31) after the separation process is finished. When, as shown in FIG. 10, the first particles that are caused to travel due to the action of the magnetic force F in a radial direction are gathered in the recess and the second particles are trapped by the magnetic filter means (9), the collecting member (31) rises and the gathered first particles are removed from the separation tank (7) as shown in FIG. 11. Since the separation apparatus of the third embodiment is configured in the same manner as the apparatus of the first embodiment except that the collecting member (31) is used to collect the first particles, further explanation related to the third embodiment is omitted.

Figure 12:
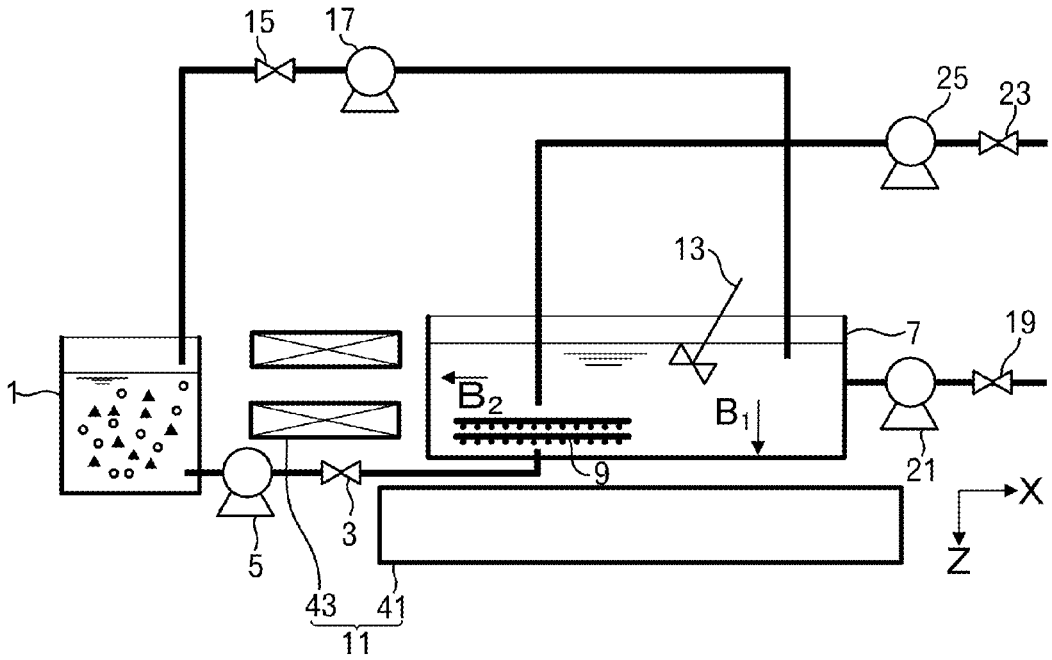
FIG. 12 is an explanatory drawing showing the outline of a mixture separation apparatus according to a fourth embodiment of the present invention.

FIG. 12 is an explanatory drawing showing the outline of a mixture separation apparatus according to a fourth embodiment of the present invention. The apparatus of the fourth embodiment uses a rectangular separation tank (7), and the magnetic field generating means (11) includes a first magnet (41) for applying a gradient magnetic field B1 in a vertical direction (z direction) to the supporting liquid in the separation tank (7) to cause the magneto-Archimedes effect to act on the first particles and a second magnet (43) for applying a gradient magnetic field B2 in a horizontal direction (x direction) to the supporting liquid in the separation tank (7) to cause the first particles to travel in the horizontal direction. For example, the first magnet (41) is a superconducting bulk magnet formed in a column shape or a disk shape, and a circular pole face thereof is made significantly larger than the bottom face of the separation tank (7). The second magnet (43) is a solenoid superconducting electromagnet and is arranged so that the central axis thereof is horizontal.

Figure 13:
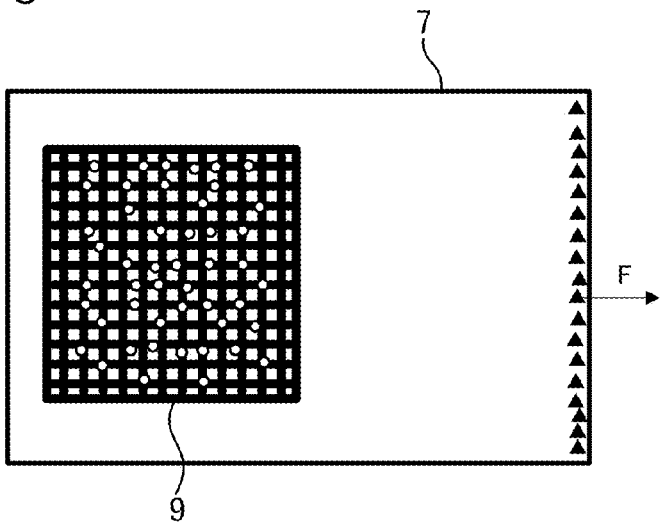
FIG. 13 is a top view of a separation tank of a mixture separation apparatus according to the fourth embodiment of the present invention.

In the separation process, the second particles (indicated by white circles) are trapped by the magnetic filter means (9). The first particles (indicated by black triangles) are caused to travel toward the right side wall surface of the separation tank (7) due to the magnetic force F in a horizontal direction, and float at the balanced height on the wall surface or at the liquid surface of the supporting liquid, or are gathered on the edge of the bottom face of the separation tank (7) at the lower end of the wall surface. FIG. 13 is a top view of the separation tank (7) after the separation process is performed. Since the apparatus of the fourth embodiment is configured in the same manner as the apparatus of the first embodiment except for these aspects and operates similarly, further explanation related to the fourth embodiment is omitted.

Figure 14:
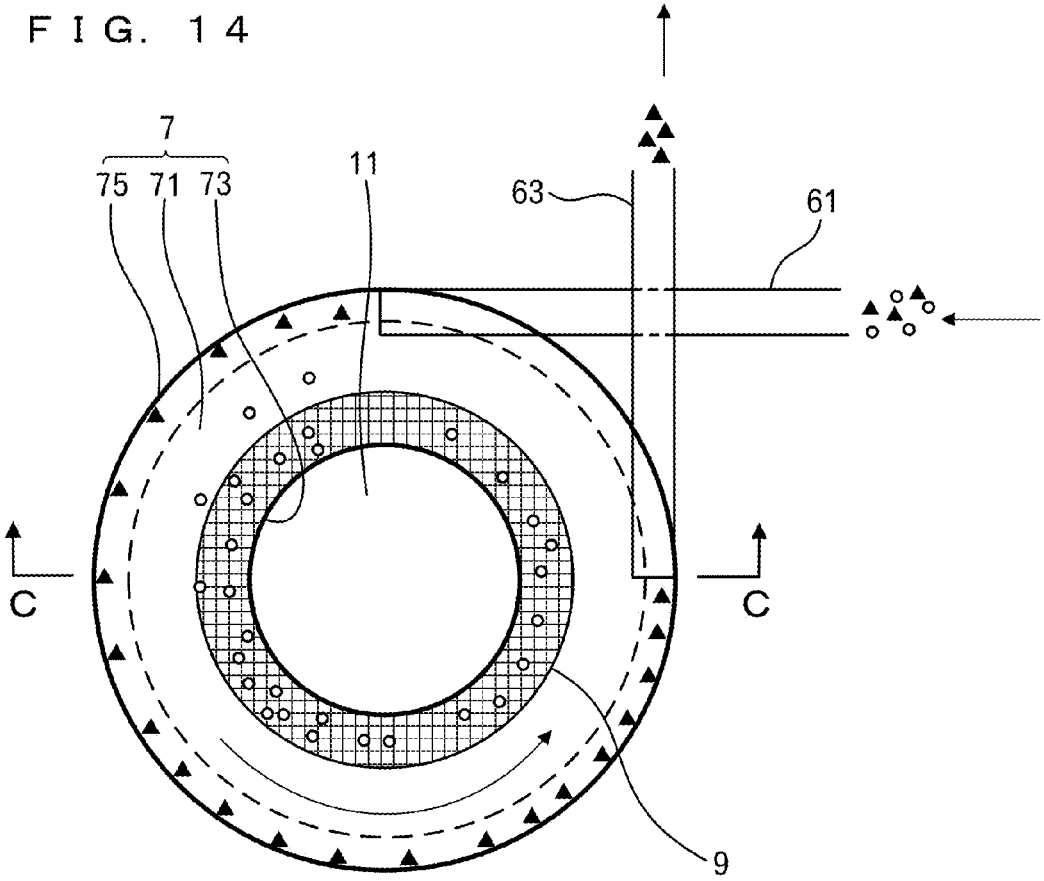
FIG. 14 is a top view of a separation tank of a mixture separation apparatus according to a fifth embodiment of the present invention.
Figure 15:
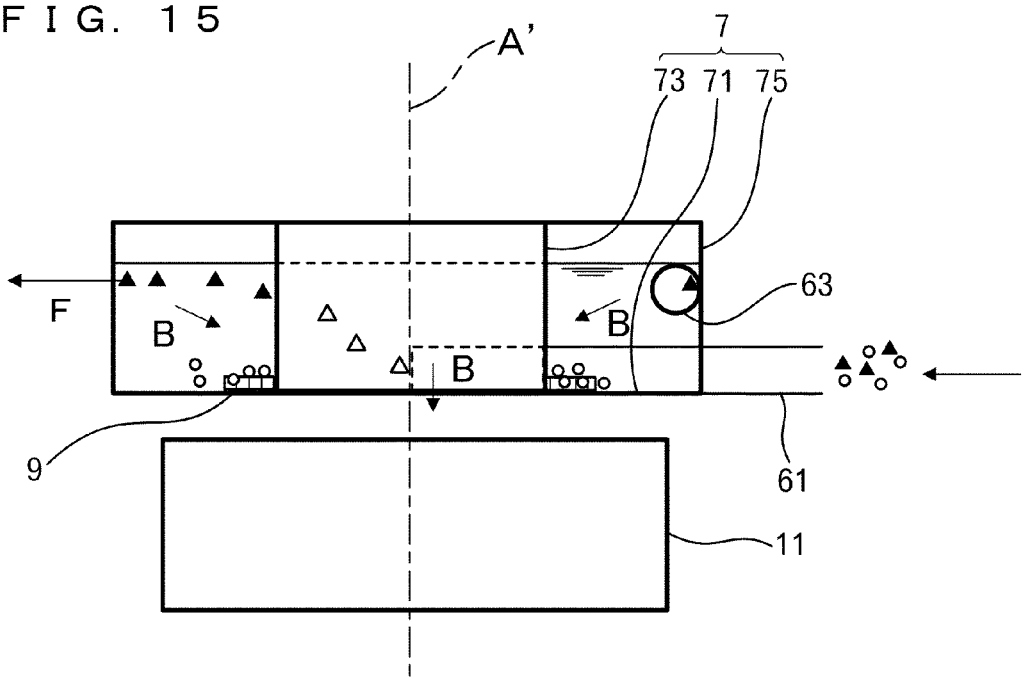
FIG. 15 is a cross-sectional arrow view taken along line C-C of FIG. 14.

FIG. 14 is a top view of a separation tank of a mixture separation apparatus according to a fifth embodiment of the present invention and FIG. 15 is a cross-sectional arrow view taken along line C-C of FIG. 14. The separation tank (7) included in the apparatus of the fifth embodiment includes an annular belt-like bottom portion (71), a cylindrical inner wall (73) connected to the inner edge of the bottom portion (71), and a cylindrical outer wall (75) coaxially arranged with respect to the inner wall (73) and connected to the outer edge of the bottom portion (71). The magnetic field generating means (11) is arranged under the bottom portion (71) of the separation tank (7). In the present embodiment, a superconducting bulk magnet formed in a column shape or a disk shape is used, and the central axis A' of the magnetic field generating means (11) is vertically arranged. The separation tank (7) is positioned with respect to the magnetic field generating means (11) so that the central axis of the inner wall (73) or the outer wall (75) overlaps with the central axis A' of the magnetic field generating means (11). For example, a solenoid superconducting electromagnet may be used as the magnetic field generating means (11) instead of a superconducting bulk magnet. In this case, it is preferable that the inner diameter of the bottom portion (71) of the separation tank (7) is larger than the bore diameter of the coil of the electromagnet.

An annular magnetic filter means (9) that is arranged so as to fit around the inner wall (73) is placed on the bottom portion (71). For example, a belt-like net or punching metal of a ferromagnetic material with an annular external shape is used for the magnetic filter means (9), and the width thereof is shorter than that of the annular belt-like bottom portion (71). The magnetic filter means (9) may be formed in a cylindrical shape and arranged so as to fit around the inner wall (73).

The separation tank (7) includes an inlet tube (61) for introducing the supporting liquid in which the mixture containing the first particles (indicated by black triangles) and the second particles (indicated by white circles) is suspended and an outlet tube (63) for discharging the supporting liquid from the separation tank (7). The supporting liquid is stored between the inner wall (73) and the outer wall (75). A storage tank for storing the supporting liquid (including the mixture), a pump for sending out the supporting liquid, and the like (not shown) are provided on the upstream side of the inlet tube (61). The amount of supporting liquid stored in the separation tank (7) is maintained constant, for example, by adjusting the flow rate of the supporting liquid sent out from the inlet tube (61).

In the present embodiment, both of the inlet tube (61) and the outlet tube (63) are arranged so as to penetrate the outer wall (75) of the separation tank (7) and be in contact with the inner surface of the outer wall (75). In addition, the inlet tube (61) is arranged in proximity to the bottom portion (71) and the outlet tube (63) is arranged above the inlet tube (61). The inlet tube (61) and the outlet tube (63) are arranged so that an annular flow of the supporting liquid is generated in the separation tank (7) and, additionally, the supporting liquid coming from the inlet tube (61) does not directly flow into the outlet tube (63).

The magnetic field generating means (11) applies a gradient magnetic field as described in the first embodiment to the supporting liquid in the separation tank (7). The gradient magnetic field causes the first particles in the supporting liquid coming out of the inlet tube (61) to be floated at the balanced height where the apparent weight is zero by the magneto-Archimedes effect in the separation tank (7), and to be disposed or gathered at the inner surface of the outer wall (75) by the action of the magnetic force F in a radial direction (where the first particles behind the inner wall (73) is indicated by white triangles in FIG. 15). The first particles that are floating at the balanced height at the inner surface of the outer wall (75) travel in a circumferential direction due to a flow (rotational flow) of the supporting liquid in the separation tank (7). The outlet tube (63) is arranged corresponding to the balanced height of the first particles, and the first particles that are floating at the balanced height are discharged together with the supporting liquid from the outlet tube (63) to the outside of the separation tank (7) and collected from the supporting liquid by a collecting means (not shown). In the present embodiment, as shown in FIG. 14, the first particles coming out of the inlet tube (61) travel along the outer wall (75) for approximately three-quarter of its circumference and are sent to the outlet tube (63).

The second particles in the supporting liquid in the separation tank (7) are caught with the magnetic filter means (9). The second particles caught with the magnetic filter means (9) are collected, for example, by being sucked with a suction tube (not shown). When the second particles are collected, it is preferable that the magnetic filter means (9) is demagnetized, for example, by rising the magnetic filter means (9) after supply of the supporting liquid to the separation tank (7) is stopped (or supporting liquid containing no mixture is introduced to the separation tank (7)) and the first particles are collected from the separation tank (7).

When the first particles sent to the separation tank (7) are disposed not at the balanced height but on the bottom portion (71) of the separation tank (7), the first particles are separated and collected by introducing the supporting liquid from the outlet tube (63) to the separation tank (7) and discharging the supporting liquid together with the first particles from the inlet tube (61) (by switching the functions of the inlet tube (61) and the outlet tube (63)).

The first to fifth embodiments described above are suitable for a case where the densities of the first particles and the second particles are larger than that of the supporting liquid. The first to fifth embodiments are changed as appropriate in a case where the densities of the first particles and the second particles are smaller than that of the supporting liquid. For example, in the first to fifth embodiments, the magnetic field generating means (11) is provided above the liquid surface of the supporting liquid stored in the separation tank (7) to apply a gradient magnetic field to the supporting liquid so that the first particles are sunk, and the magnetic filter means (9) is arranged in the vicinity of the lower end of the magnetic field generating means (11) in the supporting liquid in the separation tank (7). In the first to fourth embodiments, the stirring means (13) is arranged in the vicinity of the bottom face of the separation tank (7). The arrangement and shape of the channel, suction tube (27) and collecting member (31) for collecting the first particles and the second particles are changed as appropriate. In the fifth embodiment, the supporting liquid will be introduced from the outlet tube (63) to the separation tank (7), and discharged from the inlet tube (61).

In the first to fifth embodiment described above, a gradient magnetic field to be applied to the supporting liquid in the separation tank (7) is applied so that the first particles float in the supporting liquid or at the liquid surface thereof at least over the magnetic filter means (9) by the magneto-Archimedes effect. Furthermore, it is preferable that the gradient magnetic field is applied so that the first particles float in the supporting liquid or at the liquid surface thereof in a region where the first particles are gathered (and, additionally, in a region in the vicinity thereof) by the magneto-Archimedes effect. When the densities of the first particles and the second particles are lighter than that of the supporting liquid, the configurations of the apparatuses of these embodiments are changed so that the first particles are floated in the supporting liquid or disposed on the bottom face of the separation tank by the magneto-Archimedes effect, at least under the magnetic filter means (9). Furthermore, it is preferable that the gradient magnetic field is applied so that the first particles are floated in the supporting liquid or sunk to the bottom face of the separation tank by the magneto-Archimedes effect, in a region where the first particles are gathered (and, additionally, in a region in the vicinity thereof).

Figure 16:
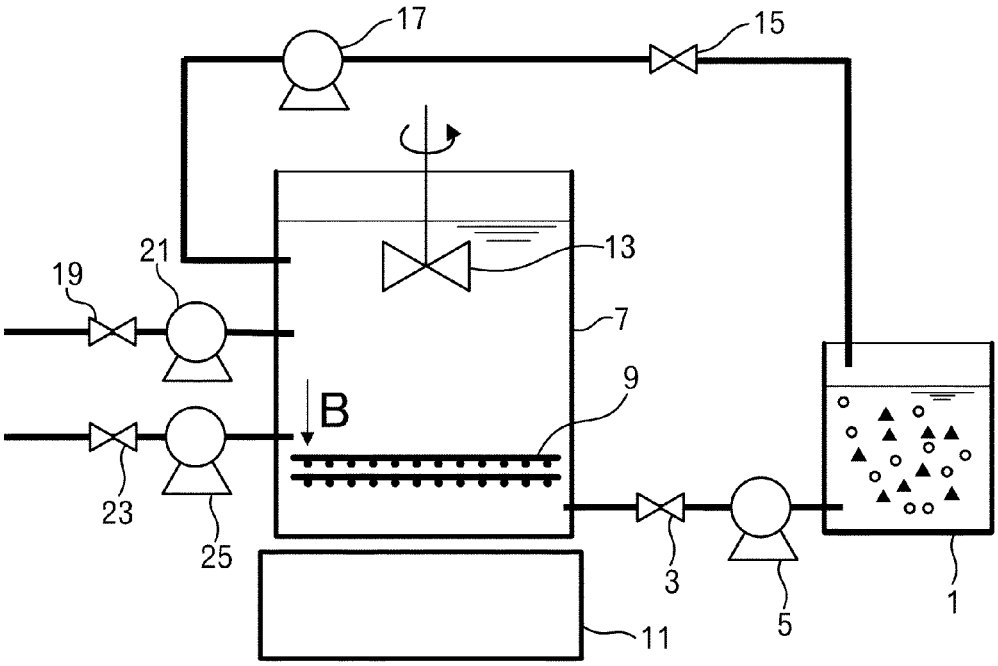
FIG. 16 is an explanatory drawing showing the outline of a mixture separation apparatus according to a sixth embodiment of the present invention.

In the first to fifth embodiments of the present invention, the first particles are caused to travel to a region lateral to or outward from the magnetic filter means (9) due to the magnetic force in a horizontal direction or a radial direction and gathered in the region, but the first particles may be gathered in a state of floating over the magnetic filter means (9). FIG. 16 is an explanatory drawing showing the outline of a mixture separation apparatus according to a sixth embodiment of the present invention. In the same manner as the foregoing embodiments, the separation apparatus of the sixth embodiment includes the storage tank (1) for storing the supporting liquid containing the mixture and the separation tank (7) that is connected to the storage tank (1) via a channel provided with the first valve (3) and the first pump (5). The first pump (5) is used to introduce the supporting liquid from the storage tank (1) to the separation tank (7), and the first valve is opened and closed as appropriate depending on the process to be performed by the separation apparatus. The mixture to be subjected to the separation treatment is placed into the supporting liquid in the storage tank (1) as appropriate. Moreover, the storage tank (1) is appropriately replenished with supporting liquid as needed.

In FIG. 16, the first particles and the second particles contained in the mixture are indicated by black triangles and white circles, respectively (in FIG. 16, the first particles and the second particles in the separation tank (7) are not shown). An aqueous solution of paramagnetic inorganic salt (e.g., 10 wt % aqueous solution of manganese chloride) is used as the supporting liquid. For example, the first particles are formed of a diamagnetic material such as glass (silica), and the second particles are formed of a paramagnetic material or an antiferromagnetic material such as titanium or nickel oxide. In the sixth embodiment, it may be preferable that the concentration of the aqueous solution of the paramagnetic salt is higher (the magnetic susceptibility of the supporting liquid is higher) than those in the first to fifth embodiments.

In the same manner as the above-described embodiments, the supporting liquid in which the first particles and the second particles are suspended is released from an outlet provided on the side wall of the separation tank (7) in the vicinity of the bottom face thereof into the separation tank (7). The magnetic filter means (9) including two net plates in the same manner as the above-described embodiments is horizontally arranged in proximity to the bottom face of the separation tank (7) so as to cover the bottom face of the separation tank (7) above the outlet of the supporting liquid.

The magnetic field generating means (11) for generating a gradient magnetic field is provided under the separation tank (7). In the present embodiment, a superconducting bulk magnet in a column shape or a disk shape is used as the magnetic field generating means (11) and, for example, a gradient magnetic field in a downward direction where the magnitude thereof monotonously decreases in an upward direction is applied to the supporting liquid in the separation tank (7). The separation tank (7) is formed of nonmagnetic materials, and planes formed by the two net plates serving as the magnetic filter means (9) are arranged so as to be substantially orthogonal with respect to the gradient magnetic field.

The present embodiment differs from the above-described embodiments in that it is not required to cause the magnetic force in the horizontal direction or the radial direction resulting from the gradient magnetic field to act on the first particles. Accordingly, a component of a horizontal or a radial direction of the magnetic field and a component of a horizontal or a radial direction of the magnetic field gradient thereof are caused to be zero or extremely minute in the separation tank (7). However, even in the sixth embodiment, the magnetic force in a horizontal direction or a radial direction may act on the first particles. In this case, the first particles will be gathered in an annular shape along the inner wall of the separation tank (7).

In the same manner as the above-described embodiments, the stirring blade that is immersed in the supporting liquid stored in the separation tank (7) is used as the stirring means (13). The stirring blade is rotated by a driving means (not shown) and generates a flow directed toward the magnetic filter means (9). It is preferable that the stirring blade is provided at a position vertically spaced from the floating position or the balanced position of the first particles. In the present embodiment, the stirring blade is arranged between the liquid surface of the supporting liquid stored in the separation tank (7) and the balanced position of the first particles described below. The supporting liquid may be stirred by causing the stirring blade to generate a rotational flow in the supporting liquid in the separation tank.

An inlet of a channel for collecting the supporting liquid is provided on the upper portion of the side wall of the separation tank (7). The channel includes a second valve (15) that is opened and closed as appropriate depending on the process to be performed by the separation apparatus and a second pump (17) for letting the supporting liquid flow from the separation tank (7) to the storage tank (1), and is used to return the supporting liquid from which the first particles and the second particles are (to some extent or substantially) removed to the storage tank (1). While the supporting liquid circulates between the storage tank (1) and the separation tank (7), the inflow of the supporting liquid into the separation tank (7) and the outflow therefrom are adjusted so that the amount of the supporting liquid in the separation tank (7) is substantially constant.

Figure 17:
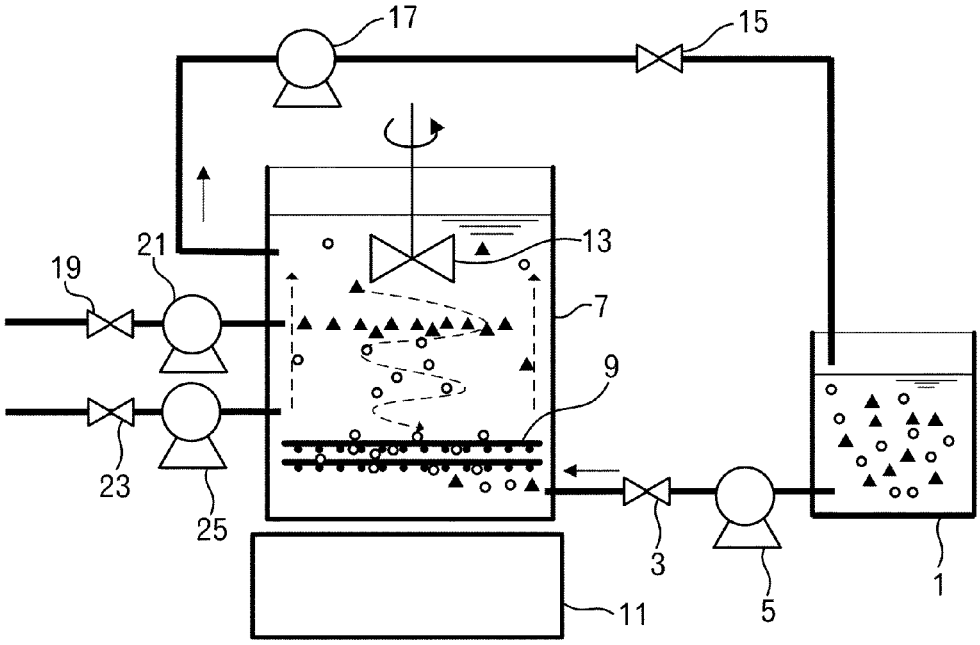
FIG. 17 is an explanatory drawing showing the operation of a mixture separation apparatus according to the sixth embodiment of the present invention.

As shown in FIG. 17, the first particles that are contained in the supporting liquid sent from the storage tank (1) to the separation tank (7) travel upward through the magnetic filter means (9). The first particles are floated at the substantially balanced height (height where the apparent weight is zero) in the supporting liquid in the separation tank (7) by the magneto-Archimedes effect, and gathered. An inlet of a channel for collecting the first particles is provided on the side wall of the separation tank (7) corresponding to the floating height or position of the first particles. The channel includes the third valve (19) that is opened and closed as appropriate depending on the process to be performed by the separation apparatus and the third pump (21) for sucking the first particles, and is used to suck the first particles and send them to a storage tank (not shown). While the first valve (3) and the second valve (15) are open and the supporting liquid circulates between the storage tank (1) and the separation tank (7), the third valve (19) is closed.

When the supporting liquid circulates between the storage tank (1) and the separation tank (7), the first particles gathered at the balanced height in the supporting liquid stored in the separation tank (7) increase over time. The stirring means (13) stirs the supporting liquid to induce the first particles in a region significantly spaced from the balanced height to the balanced height and gather them. Some of the first particles are returned to the storage tank (1) together with the supporting liquid. The degree of stirring of the supporting liquid by the stirring means (13) is adjusted so that the first particles induced to the balanced height remain at the substantially same height or are restrained in the vicinity of the height.

In the sixth embodiment, the first particles in the supporting liquid are floated at the balanced height or position corresponding to the magnetic susceptibility and the density of the first particles in the supporting liquid by the magneto-Archimedes effect, and gathered. If the particle size of the first particle is small or the viscosity of the supporting liquid is high, the motion of the first particles in the supporting liquid in the separation tank (7) is easily affected by hydrodynamic effects. Accordingly, if the particle size of the first particle is small or the viscosity of the supporting liquid is high, the first particles in a region significantly spaced from the balanced height where the apparent weight is zero tend to maintain a state of being suspended in the supporting liquid. It will take a very long time for the first particles in such a region travel to the vicinity of the balanced height by spontaneous sedimentation and obtain the magneto-Archimedes effect.

In the sixth embodiment, the stirring means (13) stirs the supporting liquid in the separation tank (7) in a state where a gradient magnetic field is applied thereto to induce the first particles suspended in a position spaced from the balanced position where the apparent weight is zero to a height region or range (including the balanced height) where the Archimedes effect works effectively, and restrain the first particles. Thereby, the period of time required for the separation treatment is shortened. Furthermore, stirring the supporting liquid is effective in suppressing aggregation of the first particles and second particles.

If the supporting liquid is strongly or vigorously stirred, the first particles that have traveled to the vicinity of the balanced height move away from the balanced height. Accordingly, the stirring means (13) stirs the supporting liquid so as not to prevent the first particles from being gathered by the magneto-Archimedes effect. When stirring is stopped, the gathered first particles are fixed at the substantially balanced height in the supporting liquid (in fact, a slight gap occurs in the heights of the particles due to contact between the particles or the like, as well as other factors). It is possible to gather the first particles at the substantially balanced height or restrain the first particles in a certain height region including the balanced height in the supporting liquid even during stirring by adjusting the stirring strength, such as the number of rotations of the stirring blade.

In the same manner as the above-described embodiments, the supporting liquid sent from the storage tank (1) to the separation tank (7) flows through the magnetic filter means (9), so that many of the second particles that are contained in the supporting liquid sent from the storage tank (1) to the separation tank (7) are trapped by the magnetic filter means (9). At that time, the second particles that are not trapped by the magnetic filter means (9) are returned to the magnetic filter means (9) and trapped by stirring the supporting liquid with the stirring means (13), or are returned to the storage tank (1) together with the supporting liquid. When the supporting liquid circulates between the storage tank (1) and the separation tank (7), the second particles caught with the magnetic filter means (9) increase over time.

Figure 18:
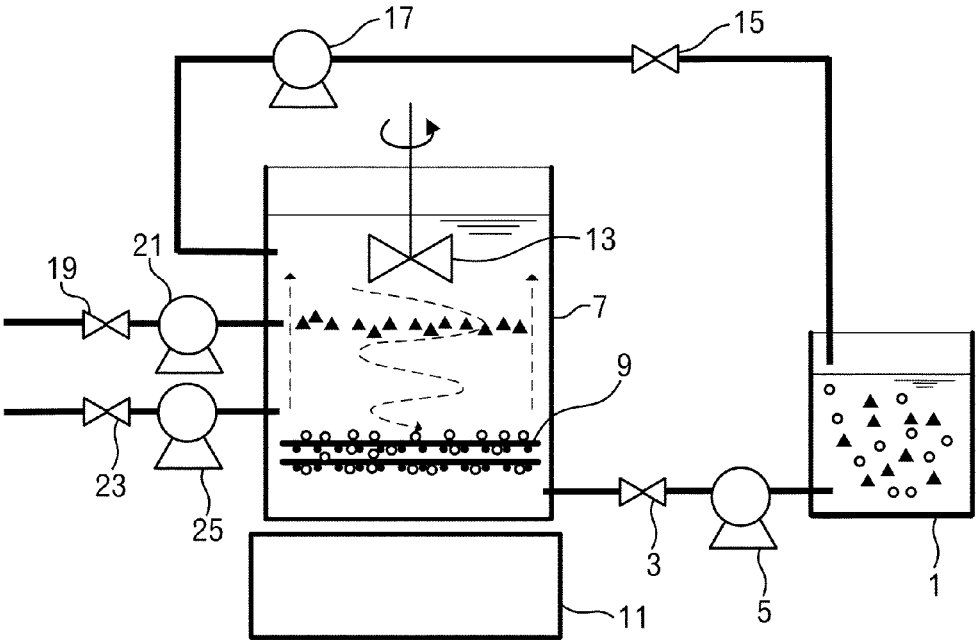
FIG. 18 is an explanatory drawing showing the operation of a mixture separation apparatus according to the sixth embodiment of the present invention.
Figure 19:
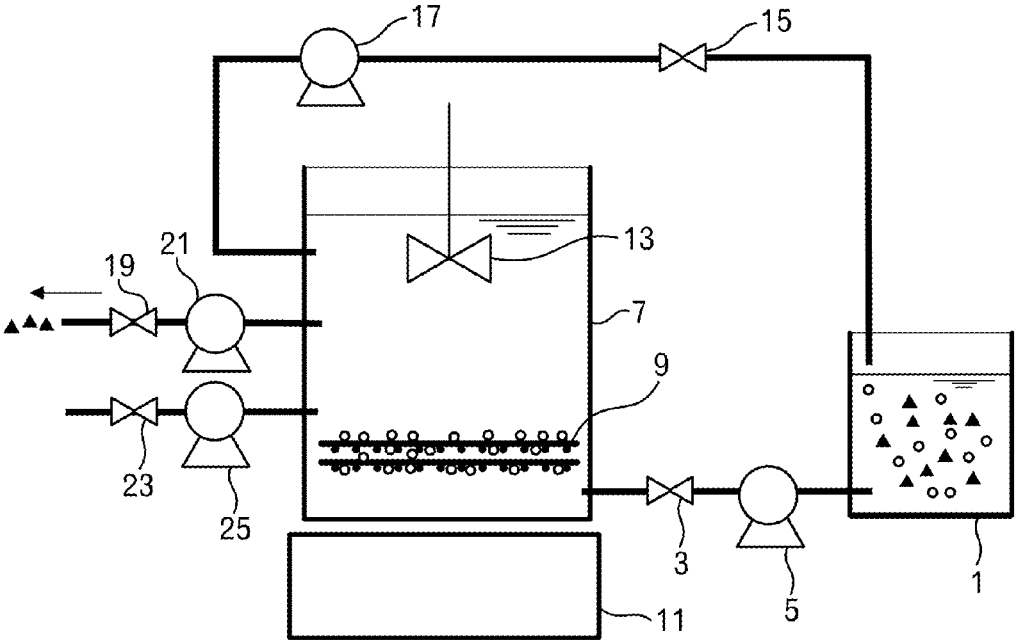
FIG. 19 is an explanatory drawing showing the operation of a mixture separation apparatus according to the sixth embodiment of the present invention.

When the above-described process has been performed for a predetermined period of time, the first valve (3) and the second valve (15) are closed and the circulation of the supporting liquid between the storage tank (1) and the separation tank (7) is stopped. After that, as shown in FIG. 18, the supporting liquid stored in the separation tank (7) is continuously stirred for a predetermined period of time to gather the first particles suspended in a region spaced from the balanced height and catch the second particles in a region spaced from the magnetic filter means (9). When the supporting liquid has been stirred for a predetermined period of time after the circulation of the supporting liquid has stopped, the stirring means (13) is stopped. The vertical distribution of the gathered first particles gets narrow so as to converge at the balanced height by stopping the stirring means (13). Then, as shown in FIG. 19, the third valve (19) is opened and a process of collecting the first particles floating at the substantially same balanced height by the magneto-Archimedes effect is performed.

Figure 20:
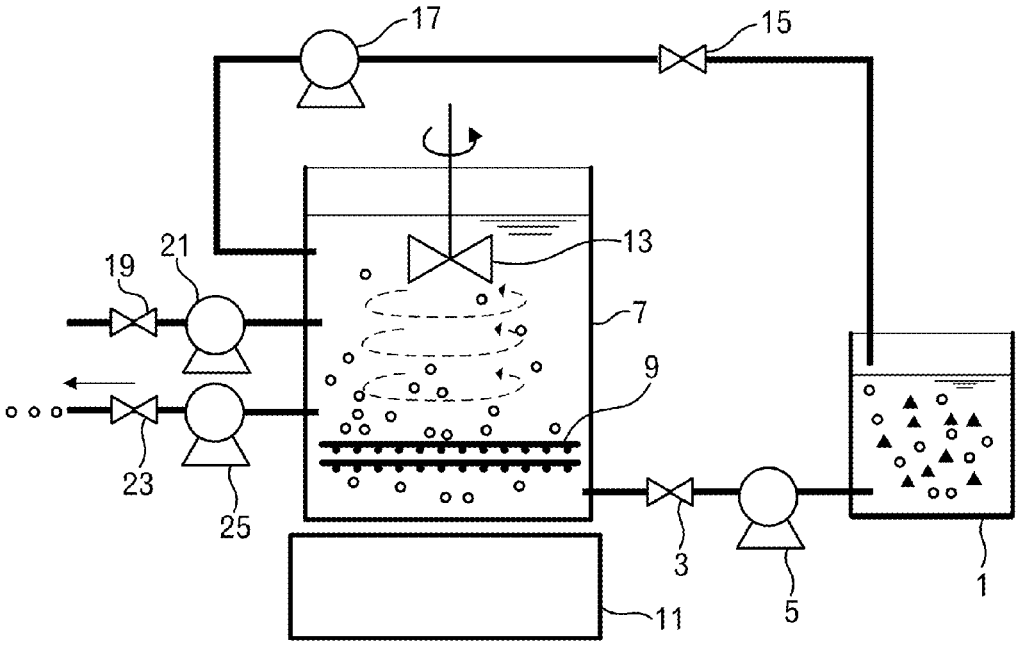
FIG. 20 is an explanatory drawing showing the operation of a mixture separation apparatus according to the sixth embodiment of the present invention.

After the process of collecting the first particles, a process of collecting the second particles is performed. After the third valve (19) is closed, as shown in FIG. 20, the second particles are separated from the magnetic filter means (9) by rotating the stirring blade of the stirring means (13) at high speed. An inlet of a channel for collecting the second particles is provided on the side wall of the separation tank (7). The channel includes the fourth valve (23) that is opened and closed as appropriate depending on the process to be performed by the separation apparatus and the fourth pump (25) for letting the supporting liquid flow out of the separation tank (7). In the process of collecting the second particles, the closed fourth valve (23) is opened, and the second particles separated from the magnetic filter means (9) are sent to a storage tank (not shown) together with the supporting liquid.

Figure 21:
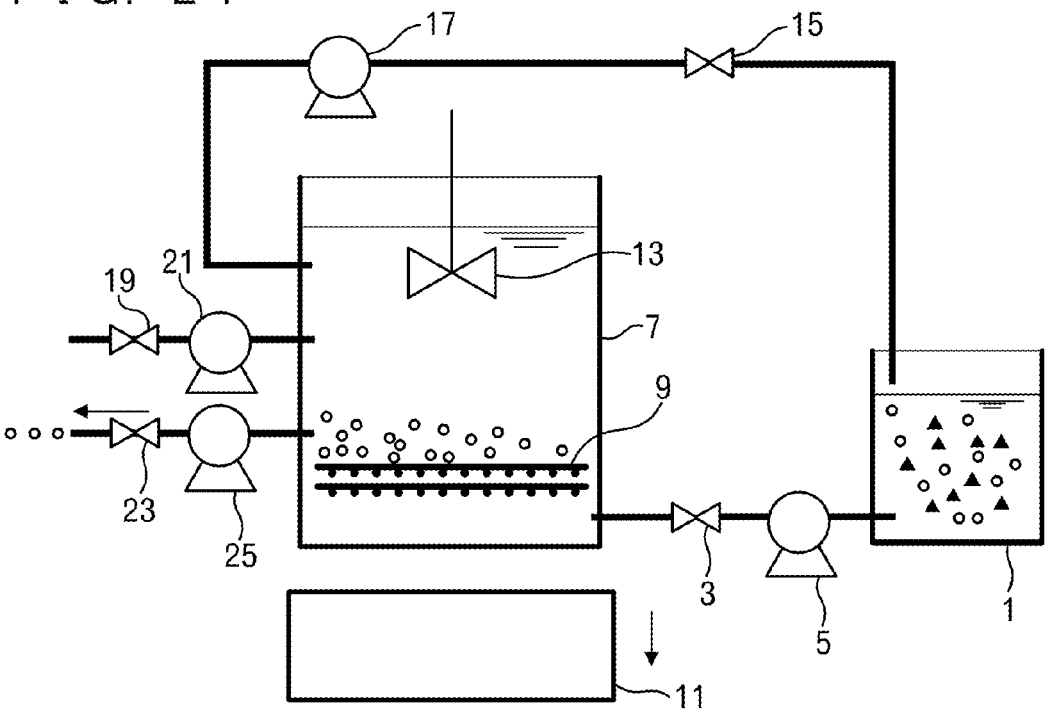
FIG. 21 is an explanatory drawing showing the operation of a mixture separation apparatus according to the sixth embodiment of the present invention.

Moreover, as shown in FIG. 21, the second particles are separated from the magnetic filter means (9) by demagnetizing or degaussing the magnetic filter means (9) and collected together with the supporting liquid. For example, a gradient magnetic field that is applied to the magnetic filter means (9) is weakened by moving the magnetic field generating means (11) downward. When an electromagnet is used for the magnetic field generating means (11), the current may be adjusted to demagnetize or degauss the magnetic filter means (9).

After the process of collecting the second particles as shown in FIG. 20 or FIG. 21 is performed, the fourth valve (23) is closed and the second valve (15) in addition to the first valve (3) is opened, so that the separation process as shown in FIG. 18 and the processes thereafter are repeatedly performed. It should be noted that the separation apparatus of the sixth embodiment may be configured so that the process of collecting the second particles is performed when the process of collecting the first particles is performed a predetermined number of times.

The sixth embodiment is suitable for a case where the densities of the first particles and the second particles are larger than that of the supporting liquid. The separation apparatus as shown in FIG. 16 is changed in a case where the densities of the first particles and the second particles are smaller than that of the supporting liquid. For example, the magnetic field generating means (11) will be provided in the vicinity of the liquid surface of the supporting liquid stored in the separation tank (7) to apply a gradient magnetic field in an upward direction where the magnitude thereof monotonously decreases in a vertically downward direction to the supporting liquid. The magnetic filter means (9) will be arranged substantially orthogonally with respect to the gradient magnetic field in the vicinity of the magnetic field generating means (11) in the supporting liquid in the separation tank (7), and the stirring means (13) will be arranged in the vicinity of the bottom face of the separation tank (7). Moreover, the supporting liquid will be supplied from the upper portion of the side wall of the separation tank (7), and discharged from the lower portion of the side wall of the separation tank (7) to be returned to the storage tank (1).

In the first to sixth embodiments described above, the mixture contains the first particles and the second particles, but a different type of particles from these particles, that is, the third particles may be contained in the mixture in the mixture separation apparatus of the present invention. The third particles may be formed of, for example, a diamagnetic material. The third particles may be disposed over or under the first particles by the magneto-Archimedes effect and gathered separately from the first particles. Moreover, the third particles may be a ferromagnetic material and trapped by the magnetic filter means (9) together with the second particles.

The embodiments for separating, by type, a mixture containing the first particles and the second particles have been described, but it is clear from the above description that the present invention is applicable to a case where either the first particles or the second particles are separated and collected from the mixture. When one or more different types of particles from the first particles and the second particles are contained in the mixture, it is clear that, by the above-described method, the first particles or the second particles are gathered or caught separately from the other particles and either the first particles or the second particles can be separated and collected from the mixture.

EXAMPLES

Hereinafter, examples in which the mixture separation method of the present invention was used to separate the mixture will be described.

First Example

Separation of Mixture of Titanium Particles (Paramagnetic Material) and Glass Particles (Diamagnetic Material)

A mixture of titanium particles and glass particles was adjusted by mixing 0.1 g of titanium powder with a particle size of 45 μm or less (manufactured by Wako Pure Chemical Industries, Ltd.; magnetic susceptibility (SI unit system): $+1.80\times10^{-4}$, density: 4.5 g/cm$^3$) and 0.05 g of glass (silica) powder with a particle size of 1 to 2 μm (manufactured by RARE METALLIC Co., Ltd.; magnetic susceptibility (SI unit system): $-1.66\times10^{-4}$, density: 2.2 g/cm$^3$).

Figure 22:
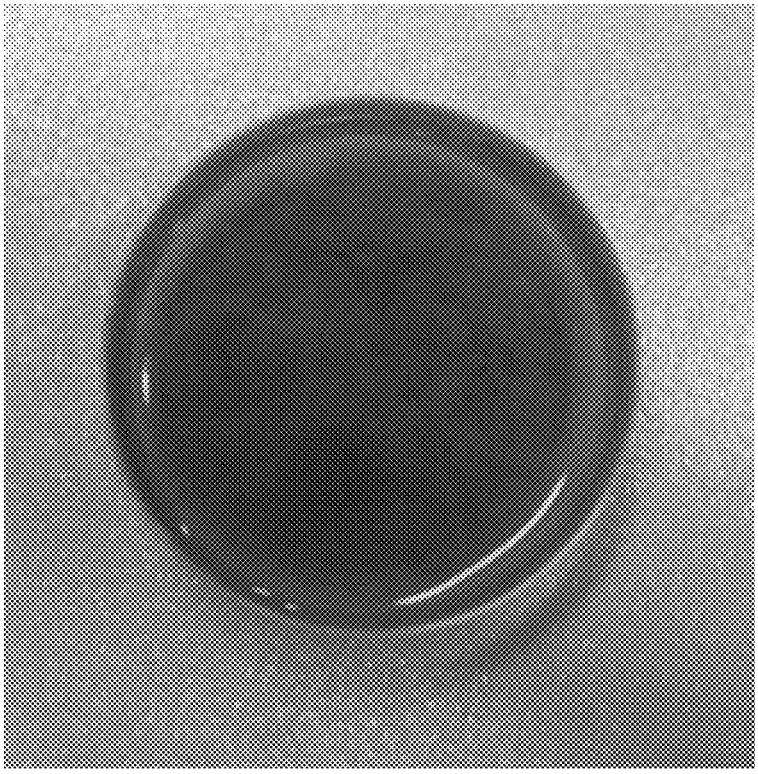
FIG. 22 is a photograph according to a first example of a mixture separation method of the present invention, showing the supporting liquid in a state where particles of the mixture are suspended therein.

Two wire nets in a square shape (10 mm×10 mm, 30 mesh, wire diameter: 0.6 mm) formed of SUS430 serving as a ferromagnetic material were vertically stacked on the bottom of a glass laboratory dish with an inner diameter of 60 mm and a height of 5 mm, and a 5 wt % aqueous solution of manganese chloride (magnetic susceptibility (SI unit system): $+3.94\times10^{-5}$) to be used as the supporting liquid was placed into the center of the laboratory dish. After this, the adjusted mixture described above was placed into the laboratory dish and the supporting liquid was stirred. Thereby, as shown in FIG. 22, the titanium particles and the glass particles were suspended to obtain a cloudy black supporting liquid. It should be noted that the height of the liquid surface of the supporting liquid was set to be a little lower than that of the laboratory dish.

Figure 23:
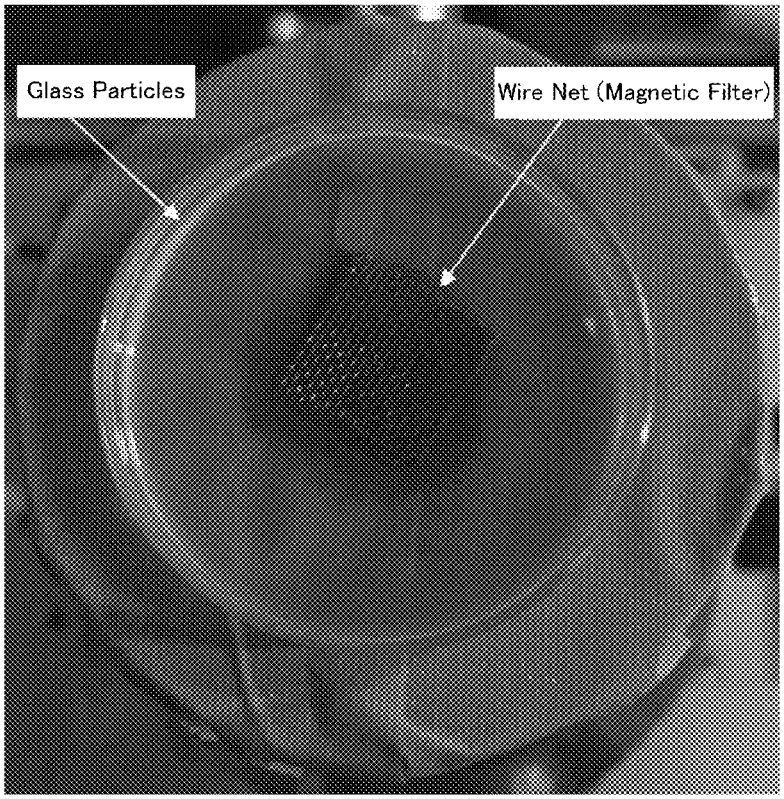
FIG. 23 is a photograph according to the first example of a mixture separation method of the present invention, showing the supporting liquid in a state where particles of the mixture are separated.

Next, the laboratory dish containing the supporting liquid in which the titanium particles and the glass particles were suspended as shown in FIG. 22 and the two wire nets was mounted on the upper end surface of a cylindrical vacuum chamber housing a columnar superconducting bulk magnet (ϕ60 mm×h 20 mm) (it should be noted that, as shown in FIG. 23, a brown fabric tape was stuck on the upper end surface of the vacuum chamber for photography). The laboratory dish was arranged so that the center of the circular upper end surface of the vacuum chamber and the center of the bottom face of the laboratory dish overlapped. Thereby, a gradient magnetic field that was axially symmetrical about the central axis (of the magnet) in a vertical direction was applied to the supporting liquid in the laboratory dish. The magnitude of the gradient magnetic field outwardly decreased in a radial direction, and the magnetic field gradient and the magnetic field had a component of a radial direction in addition to a component of a vertical direction. It should be noted that the maximum value of the magnitude of the applied gradient magnetic field was approximately 5 T (tesla) at the center of the upper end surface of the vacuum chamber. Moreover, the magnitude of the vertical component of the applied magnetic field gradient was approximately 300 T/m at the center of the end surface.

When the gradient magnetic field was applied to the supporting liquid in the laboratory dish, the glass particles traveled toward the inner wall surface of the laboratory dish and were immediately (in less than 1 second) gathered in an annular shape on the edge of the bottom face of the laboratory dish. Furthermore, when the supporting liquid in the laboratory dish was stirred with a stirring rod for 5 to 10 seconds, as shown in FIG. 23, the titanium particles suspended in the supporting liquid adsorbed on the wire nets, the titanium particles and the glass particles were separated by type, and the supporting liquid became clear. A small amount of the titanium particles accumulated around the wire nets on the bottom face of the laboratory dish, but the titanium particles and the glass particles contained in the mixture were favorably separated by type. It should be noted that the titanium particles that accumulate on the bottom face of the laboratory dish may be trapped by the wire nets by increasing the number of wire nets or enlarging the gradient magnetic field.

It was confirmed that a gradient magnetic field is thus applied to the paramagnetic supporting liquid in which the mixture of diamagnetic particles (glass particles) and paramagnetic particles (titanium particles) is suspended based on the present invention, so that the diamagnetic particles can be gathered in a region spaced from the magnetic filter means (wire net) and the paramagnetic particles can be caught with the magnetic filter means excited by the applied gradient magnetic field. Furthermore, it was confirmed that diamagnetic particles or paramagnetic particles can be separated from such a mixture based on the present invention. Moreover, it was confirmed that diamagnetic particles and paramagnetic particles can be separated by type, or diamagnetic particles or paramagnetic particles can be separated from the mixture by the present invention even if a 5 wt % aqueous solution of manganese chloride, which has a relatively low concentration, is used as the supporting liquid and the supporting liquid is stored at a very shallow depth of approximately 5 mm.

Second Example

Separation of Mixture of Titanium Particles (Paramagnetic Material) and Glass Particles (Diamagnetic Material)

The two wire nets used in the first example were stacked on the bottom of a glass vial with an inner diameter of 20 mm and a height of 50 mm, and 25 ml of a 10 wt % aqueous solution of manganese chloride (magnetic susceptibility (SI unit system): $+8.57\times10^{-5}$) to be used as the supporting liquid was placed into the vial. The same mixture as in the first example was placed into the vial and the supporting liquid was stirred. Thereby, as shown in FIG. 24, the titanium particles and the glass particles were suspended to obtain the cloudy black supporting liquid.

Figure 24:
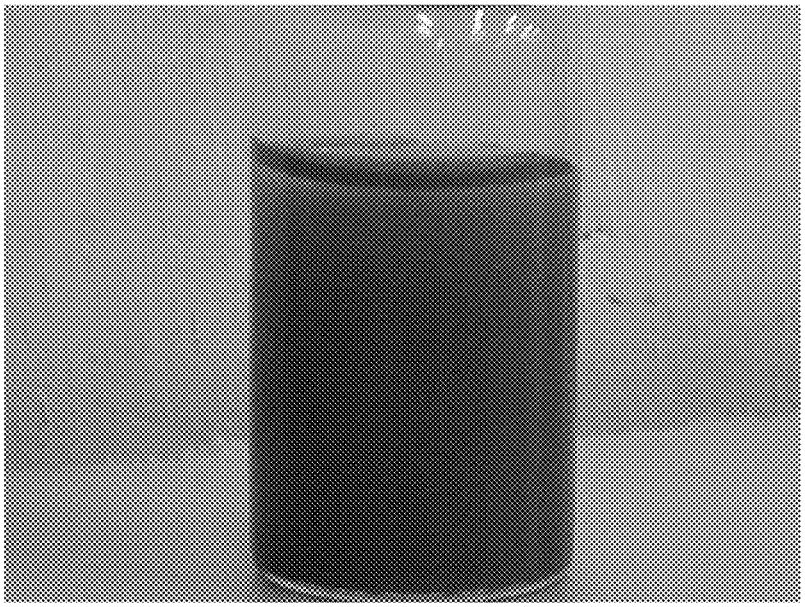
FIG. 24 is a photograph showing an initial state (suspended state) of the supporting liquid in a second example of a mixture separation method of the present invention.

Next, the vial containing the supporting liquid in which the titanium particles and the glass particles were suspended as shown in FIG. 24 and the two nets was mounted on the upper end surface of the above-described vacuum chamber housing a superconducting bulk magnet. Thereby, a gradient magnetic field in a vertically upward direction in which a magnetic field gradient had a vertical component was applied to the supporting liquid in the vial. The vial was arranged so that the center of the bottom face thereof was positioned at the center of the upper end surface of the vacuum chamber.

Figure 25:
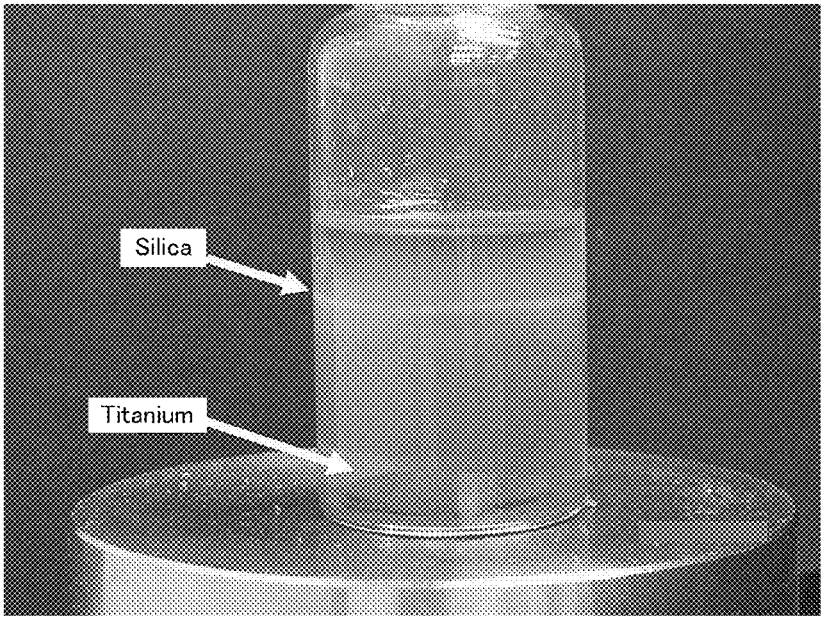
FIG. 25 is a photograph showing a separated state of the mixture in the second example of a mixture separation method of the present invention.

When the gradient magnetic field was applied to the supporting liquid in the vial, it was confirmed that the glass particles floated in the supporting liquid and gathered at a position approximately 20 mm above the upper end surface of the vacuum chamber (magnitude of the magnetic field: approximately 1.2 T, magnitude of the magnetic field gradient: approximately 70 T/m). When the supporting liquid in the vial was stirred with a stirring rod for 3 minutes (it was confirmed that the glass (silica) particles were gathered at the above-described position while stirring), as shown in FIG. 25, the titanium particles suspended in the supporting liquid adsorbed on the wire nets, and the titanium particles and the glass particles were favorably separated. Although a small amount of the titanium particles were attached to the inner wall of the vial, the clear supporting liquid was confirmed visually.

As shown in FIG. 25, the glass particles float above the two wire nets used as the magnetic filter means in the supporting liquid. When the amount of the supporting liquid in the vial is reduced and the liquid surface of the supporting liquid is lower than the position shown in FIG. 25, the glass particles float at the liquid surface of the supporting liquid. Therefore, it can be understood that, in the above-described first example, when a gradient magnetic field is applied, the glass particles float at the liquid surface of the supporting liquid over the two wire nets by the magneto-Archimedes effect and, in addition, travel toward the inner wall surface of the laboratory dish.

Third Example

Separation of Mixture of Titanium Particles (Paramagnetic Material) and Glass Particles (Diamagnetic Material)

A mixture of titanium particles and glass particles was adjusted by mixing 0.1 g of the above-described titanium powder and 0.15 g of glass (silica) beads with a particle size of approximately 2 mm (manufactured by AS ONE Corporation; magnetic susceptibility (SI unit system): $-1.66\times10^{-4}$, density: 2.2 g/cm$^3$). The same treatments as in the second example were performed, except that the supporting liquid was stirred for 2 minutes.

Before a gradient magnetic field was applied to the vial, the titanium particles and the glass particles were suspended and the supporting liquid was also cloudy black in the third example as in the initial state of the second example shown in FIG. 24. When the gradient magnetic field was applied to the supporting liquid in the vial, it was confirmed that the glass particles floated in the supporting liquid and gathered at a position approximately 20 mm above the flat surface of the vacuum chamber. When the supporting liquid in the vial was stirred with a stirring rod for 2 minutes (it was confirmed that the glass (silica) particles gathered at the above-described position while stirring), the titanium particles suspended in the supporting liquid adsorbed on the wire nets, and the titanium particles and the glass particles were favorably separated. Although a small amount of the titanium particles were attached to the inner wall of the vial, the clear supporting liquid was confirmed visually.

Fourth Example

Separation of Mixture of Nickel Oxide Particles (Antiferromagnetic Material) and Glass Particles (Diamagnetic Material)

A mixture of nickel oxide particles and glass particles was adjusted by mixing 0.1 g of nickel oxide powder with a particle size of 20 μm or less (manufactured by Wako Pure Chemical Industries, Ltd.; magnetic susceptibility (SI unit system): $+4.50\times10^{-4}$, density: 6.7 g/cm$^3$) and 0.05 g of glass (silica) granules used in the first example. The same treatments as in the second example were performed, except that the vial was mounted through an acrylic plate with a thickness of 2 mm on the upper end surface of the above-described vacuum chamber housing a superconducting bulk magnet.

Figure 26:
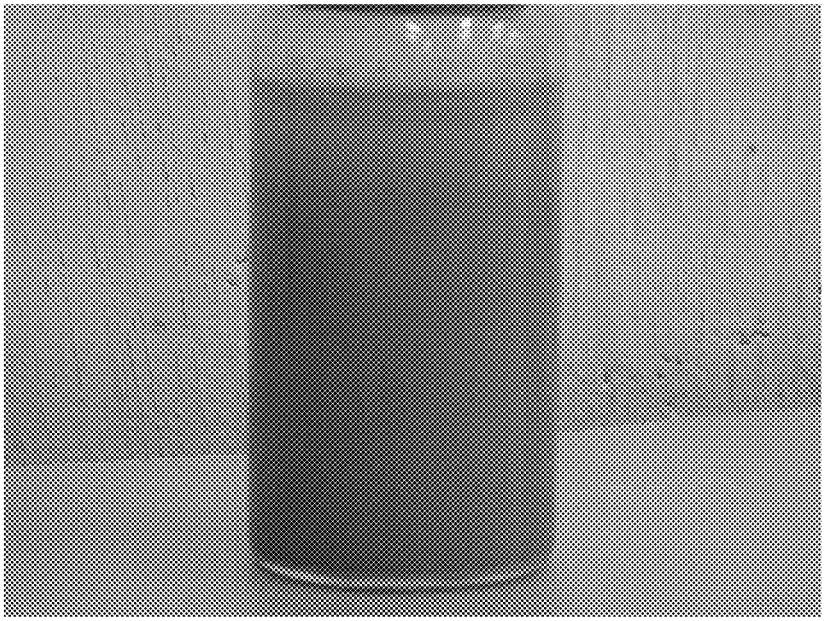
FIG. 26 is a photograph showing an initial state (suspended state) of the supporting liquid in a fourth example of a mixture separation method of the present invention.
Figure 27:
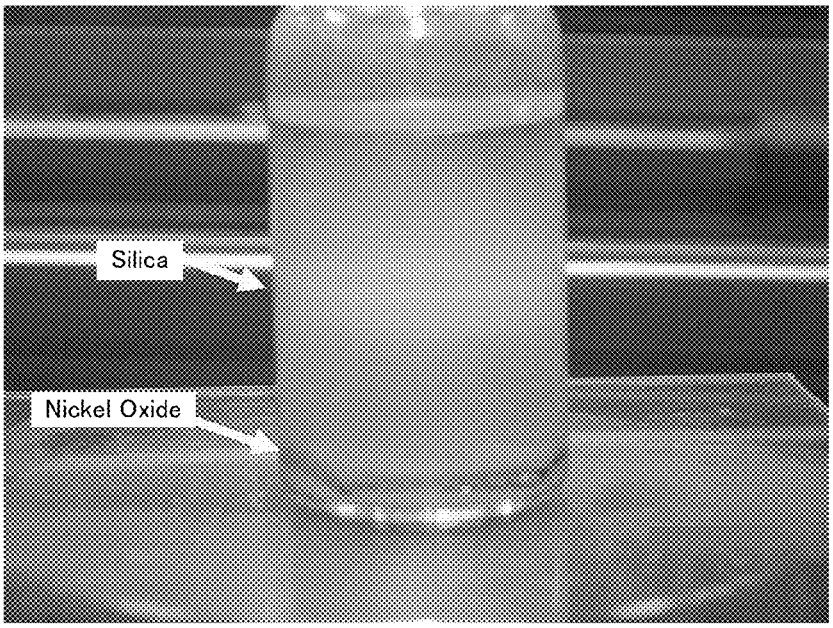
FIG. 27 is a photograph showing a separated state of the mixture in the fourth example of a mixture separation method of the present invention.

Before a gradient magnetic field was applied to the vial, the nickel oxide particles and the glass particles were suspended and the supporting liquid was cloudy green as shown in FIG. 26. When the gradient magnetic field was applied to the vial, it was confirmed that the glass particles floated in the supporting liquid and gathered in the vicinity of a position approximately 20 mm above the upper end surface of the vacuum chamber. When the supporting liquid in the vial was stirred with a stirring rod for 2 minutes (it was confirmed that the glass (silica) particles were gathered at the above-described position while stirring), as shown in FIG. 27, the nickel oxide particles suspended in the supporting liquid adsorbed on the wire nets, and the nickel oxide particles and the glass particles were favorably separated. Although a small amount of the nickel oxide particles were attached to the inner wall of the vial, the clear supporting liquid was confirmed visually.

Fifth Example

Separation of Mixture of Nickel Oxide Particles (Antiferromagnetic Material) and Glass Particles (Diamagnetic Material)

A mixture of nickel oxide particles and glass particles was adjusted by mixing 0.1 g of nickel oxide described above and 0.15 g of glass (silica) beads used in the third example. The same treatments as in the fourth example were performed, except that the supporting liquid was stirred for 1 minute.

Before a gradient magnetic field was applied to the vial, the nickel oxide particles and the glass particles were suspended and the supporting liquid was also cloudy green in the fifth example as in the initial state of the fourth example shown in FIG. 26. When the gradient magnetic field was applied to the vial, it was confirmed that the glass particles (glass beads) floated in the supporting liquid and gathered in the vicinity of a position approximately 20 mm above the upper end surface of the vacuum chamber. When the supporting liquid in the vial was stirred with a stirring rod for 1 minute (it was confirmed that the glass particles were gathered at the above-described position while stirring), the nickel oxide particles suspended in the supporting liquid adsorbed on the wire nets, and the nickel oxide particles and the glass particles were favorably separated. Although a small amount of the nickel oxide particles were attached to the inner wall of the vial, the clear supporting liquid was confirmed visually.

It was actually confirmed by the second example that when the second particles are formed of a paramagnetic material and the first particles are formed of a diamagnetic material, the mixture containing these first and second particles can be separated by type using the present invention. Furthermore, it was actually confirmed by the fourth example that when the second particles are formed of an antiferromagnetic material and the first particles are formed of a diamagnetic material, the mixture containing these first and second particles can be separated by type using the present invention. Moreover, it can be understood that the present invention is applicable to particles of various sizes or mixture of particles of various sizes with reference to the third and fifth examples in addition to the second and fourth examples.

Hereinafter, comparative examples implemented using conventional technologies in order to compare the conventional technologies and the present invention will be described.

First Comparative Example

Magneto-Archimedes Separation of Mixture of Titanium Particles and Glass Particles A mixture of titanium particles and glass particles was adjusted in the same manner as in the second example. The mixture was placed into a vial containing 25 ml of a 10 wt % aqueous solution of manganese chloride serving as the supporting liquid and stirred. It should be noted that the above-described wire net was not arranged in the vial. After being stirred, in the same manner as in the second example, a gradient magnetic field was applied to the supporting liquid in the vial in which the titanium particles and the glass particles were suspended, and the vial was allowed to stand for 3 minutes. Then, it was confirmed that the glass particles gathered at a position 20 mm above the upper end surface of the vacuum chamber. However, although those titanium particles which had a large particle size sunk to the bottom face of the vial, most of the titanium particles (and some of glass particles) remained suspended in the supporting liquid, and the supporting liquid remained cloudy black as in the initial state shown in FIG. 24. Thus, in the first comparative example in which only the magneto-Archimedes method was used, the mixture containing the paramagnetic particles and the diamagnetic particles could not be separated as in the second example.

Second Comparative Example

Figure 28:
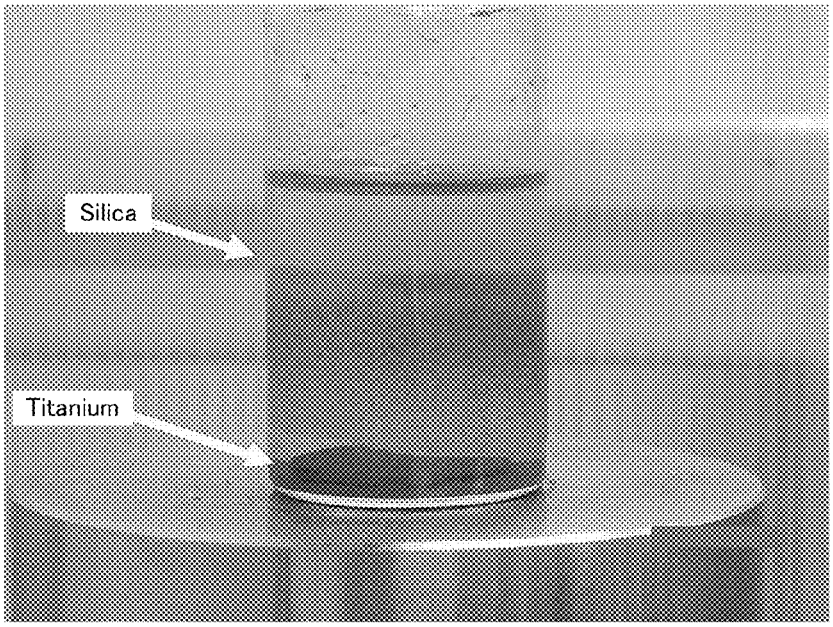
FIG. 28 is a photograph showing a state of the supporting liquid in a second comparative example according to the present invention.

Magneto-Archimedes Separation+HGMS Separation of Mixture of Titanium Particles and Glass Particles A mixture of titanium particles and glass particles was adjusted in the same manner as in the second example. The mixture was placed into a vial in which 25 ml of a 10 wt % aqueous solution of manganese chloride serving as the supporting liquid was contained and the two above-described wire nets were arranged on the bottom portion, and stirred. After that, in the same manner as in the second example, a gradient magnetic field was applied to the supporting liquid in the vial in which the titanium particles and the glass particles were suspended, and the vial was allowed to stand for 5 minutes. Then, it was confirmed that the glass particles gathered at a position 20 mm above the upper end surface of the vacuum chamber as shown in FIG. 28. However, although a certain amount of the titanium particles adsorbed on the wire nets, a significant amount of the titanium particles (and some of glass particles) remained suspended in the supporting liquid, and the supporting liquid was cloudy. Thus, in the second comparative example in which the magneto-Archimedes method and the HGMS method were used, the mixture containing the paramagnetic particles and the diamagnetic particles could not be favorably separated in a short time as in the second example.

Third Comparative Example

Magneto-Archimedes Separation of Mixture of Nickel Oxide Particles and Glass Particles A mixture of nickel oxide particles and glass particles was adjusted in the same manner as in the fourth example. The mixture was placed into a vial containing 25 ml of a 10 wt % aqueous solution of manganese chloride serving as the supporting liquid and stirred. It should be noted that the above-described wire net was not arranged in the vial. After being stirred, in the same manner as in the fourth example, a gradient magnetic field was applied to the supporting liquid in the vial in which the nickel oxide particles and the glass particles were suspended, and the vial was allowed to stand for 2 minutes. Then, it was confirmed that the glass particles were gathered at a position 20 mm above the upper end surface of the vacuum chamber. However, although those titanium particles which had a large particle size sunk to the bottom face of the vial, most of the titanium particles remained suspended in the supporting liquid, and the supporting liquid remained cloudy green as in the initial state shown in FIG. 26. Thus, in the third comparative example in which only the magneto-Archimedes method was used, the mixture containing the paramagnetic particles and the diamagnetic particles could not be separated as in the fourth example.

Fourth Comparative Example

Magneto-Archimedes Separation+HGMS Separation of Mixture of Nickel Oxide Particles and Glass Particles A mixture of nickel oxide particles and glass particles was adjusted in the same manner as in the second example. The mixture was placed into a vial in which 25 ml of a 10 wt % aqueous solution of manganese chloride serving as the supporting liquid was contained and the two above-described wire nets were arranged on the bottom portion, and stirred. After that, in the same manner as in the fourth example, a gradient magnetic field was applied to the supporting liquid in the vial in which the titanium particles and the glass particles were suspended, and the vial was allowed to stand for 5 minutes. Then, it was confirmed that the glass particles gathered at a position 20 mm above the upper end surface of the vacuum chamber. However, although a certain amount of the titanium particles adsorbed on the wire nets, a significant amount of the titanium particles (and part of glass particles) remained suspended in the supporting liquid, and the supporting liquid was cloudy. Thus, in the fourth comparative example in which the magneto-Archimedes method and the HGMS method were used, the mixture containing the paramagnetic particles and the diamagnetic particles could not be favorably separated in a short time as in the fourth example.

It is found from the result of the first comparative example that it is difficult to separate the same mixture as in the second example by the magneto-Archimedes effect using the same supporting liquid and gradient magnetic field as in the second example, that is, with the present invention, a mixture containing paramagnetic particles and diamagnetic particles can be separated without increasing the magnetic susceptibility of the supporting liquid or enlarging the gradient magnetic field compared to conventional technologies. Moreover, it is found from the result of the third comparative example that it is not possible to separate the same mixture as in the fourth example by the magneto-Archimedes effect using the same supporting liquid and gradient magnetic field as in the fourth example, that is, with the present invention, a mixture containing antiferromagnetic particles and diamagnetic particles can be separated without increasing the magnetic susceptibility of the supporting liquid or enlarging the gradient magnetic field compared to conventional technologies. Furthermore, it can be understood from the results of the second and fourth comparative examples that the period of time required for the separation treatment of the mixture is significantly shortened or the mixture can by favorably separated by stirring the supporting liquid.

INDUSTRIAL APPLICABILITY

Since it is possible to separate, by type, a mixture containing two types of particles and separately collect the particles from the mixture, or to separate a specific type of particle from such a mixture, the present invention is applicable to recycle processing of industrial wastes and household garbage. Particularly, since the present invention is suitable for separating a mixture containing diamagnetic particles and paramagnetic particles, the present invention is applicable to collection of rare earth from household electric appliances or the like.

The description above has been given for illustrating the present invention, and should not be construed as limiting the invention described in the claims or as restricting the claims. Furthermore, it will be appreciated that the constituent elements of the invention are not limited to those in the foregoing examples, and various modifications can be made without departing from the technical scope described in the claims.

LIST OF REFERENCE NUMERALS (1) storage tank
(7) separation tank
(9) magnetic filter means
(11) magnetic field generating means
(13) stirring means

The invention claimed is:

1. A mixture separation method for applying a gradient magnetic field to a paramagnetic supporting liquid containing a mixture of first particles and second particles of different types to separate the mixture by particle type, wherein a magnetic susceptibility of the first particles is lower than a magnetic susceptibility of the supporting liquid, and a magnetic susceptibility of the second particles is higher than the magnetic susceptibility of the supporting liquid, the mixture separation method comprising:

applying the gradient magnetic field to the supporting liquid in a separation tank provided with a magnetic filter and stirring the supporting liquid;

applying the gradient magnetic field so that the first particles float in the supporting liquid or at a liquid surface thereof by the magneto-Archimedes effect, at least over the magnetic filter; and catching the second particles in the supporting liquid with the magnetic filter excited by the gradient magnetic field.

2. The mixture separation method according to claim 1, wherein a horizontal magnetic force acts on the first particles by the gradient magnetic field, and the first particles travel to a region lateral to or outward from the magnetic filter by the magnetic force and are gathered in the region.

3. The mixture separation method according to claim 1, wherein the first particles are all disposed at a single elevation in the supporting liquid.

4. The mixture separation method according to claim 1, wherein the gradient magnetic field is axially symmetrical about a central axis in a vertical direction, a magnetic field gradient of the gradient magnetic field has a component of a vertical direction and a component of a radial direction, and a magnetic force in a radial direction is applied to the first particles so that the first particles move away from the central axis by applying the gradient magnetic field to the supporting liquid.

5. The mixture separation method according to claim 1, wherein the first particles are formed of a diamagnetic substance or a paramagnetic substance, the second particles are formed of a paramagnetic substance or an antiferromagnetic substance, and the supporting liquid is an aqueous solution of a paramagnetic inorganic salt.

6. The mixture separation method according to claim 1, wherein the magnetic includes a net plate formed of a ferromagnetic substance, and the gradient magnetic field is applied orthogonally to the net plate.

7. A mixture separation method for applying a gradient magnetic field to a paramagnetic supporting liquid containing a mixture of first particles and second particles of different types to separate the first particles or the second particles from the mixture, wherein a magnetic susceptibility of the first particles is lower than a magnetic susceptibility of the supporting liquid, and a magnetic susceptibility of the second particles is higher than the magnetic susceptibility of the supporting liquid, the mixture separation method comprising:

applying the gradient magnetic field to the supporting liquid in a separation tank provided with a magnetic filter and stirring the supporting liquid;

applying the gradient magnetic field so that the first particles float in the supporting liquid or at a liquid surface thereof by the magneto-Archimedes effect, at least over the magnetic filter; and catching the second particles in the supporting liquid with the magnetic filter excited by the gradient magnetic field.

8. The mixture separation method according to claim 7, wherein a horizontal magnetic force acts on the first particles by the gradient magnetic field, and the first particles travel to a region lateral to or outward from the magnetic filter by the magnetic force and are gathered in the region.

9. The mixture separation method according to claim 7, wherein the first particles are disposed at the same elevation in the supporting liquid.

10. The mixture separation method according to claim 7, wherein the gradient magnetic field is axially symmetrical about a central axis in a vertical direction, a magnetic field gradient of the gradient magnetic field has a component of a vertical direction and a component of a radial direction, and a magnetic force in a radial direction is applied to the first particles so that the first particles move away from the central axis by applying the gradient magnetic field to the supporting liquid.

11. The mixture separation method according to claim 7, wherein the first particles are formed of a diamagnetic substance or a paramagnetic substance, the second particles are formed of a paramagnetic substance or an antiferromagnetic substance, and the supporting liquid is an aqueous solution of a paramagnetic inorganic salt.

12. The mixture separation method according to claim 7, wherein the magnetic filter includes a net plate formed of a ferromagnetic substance, and the gradient magnetic field is applied orthogonally to the net plate.

* * * * *